United States Patent [19]

Yamauchi et al.

[11] Patent Number: 4,986,338

[45] Date of Patent: Jan. 22, 1991

[54] GAS VENTING ARRANGEMENT IN HIGH SPEED INJECTION MOLDING APPARATUS AND METHOD FOR VENTING GAS IN THE HIGH SPEED INJECTION MOLDING APPARATUS

[75] Inventors: Noriyoshi Yamauchi; Hitoshi Ishida; Kazuaki Kawai; Yasuyuki Mizukusa, all of Fuchu, Japan

[73] Assignee: Ryobi Ltd., Hiroshima, Japan

[21] Appl. No.: 334,373

[22] Filed: Apr. 6, 1989

[30] Foreign Application Priority Data

May 16, 1988 [JP] Japan ..... 63-64851[U]
Jun. 24, 1988 [JP] Japan ..... 63-157511

[51] Int. Cl.[5] ..... B22D 17/00

[52] U.S. Cl. ..... 164/457; 164/113; 164/305; 164/312; 164/410; 164/154

[58] Field of Search ..... 164/305, 312, 410, 150, 164/154, 4.1, 113, 457

[56] References Cited

U.S. PATENT DOCUMENTS 4,463,793 8/1984 Thurner ..... 164/155
4,852,634 8/1989 Kawai et al. ..... 164/457

FOREIGN PATENT DOCUMENTS 146152 1/1981 Fed. Rep. of Germany .
60-49852 3/1985 Japan .
61-195853 12/1986 Japan .
63-60059 3/1988 Japan .

*Primary Examiner*—Richard K. Seidel
*Attorney, Agent, or Firm*—Oliff & Berridge

[57] ABSTRACT

A gas venting arrangement in a high speed injection molding apparatus such as a high speed die casting machine. The gas venting arrangement includes a gas vent control valve which is closable at an optimum timing and at high speed. This valve closure is achievable by providing an improved combination of a control circuit and a valve driving mechanism. The control circuit is connected to a molten metal sensor and sends a high voltage output drive signal to the valve driving mechanism when the sensor detects a first molten metal or a metal splash. The valve driving mechanism includes an electromagnetic valve connected to a pneumatic source and a pneumatically operated valve connected between the electromagnetic valve and the gas vent control valve. The pneumatically operated valve is also connected to the pneumatic source. The electromagnetic valve performs prompt change-over operation upon receiving the drive signal, and supplies driving pneumatic pressure to the pneumatically operated valve. The pneumatically operated valve performs prompt change-over operation upon receiving the driving pneumatic pressure for promptly applying pneumatic pressure to the gas vent control valve, to thereby close the same at high speed and at optimum timing without delay.

16 Claims, 12 Drawing Sheets

| UNIT OF VERTICAL AXIS | | |
|---|---|---|
| A | VOLTAGES | V |
| B | PNEUMATIC PRESSURE | kgf/cm2 |
| C | PLACEMENT OF VALVE | mm |

GAS VENTING ARRANGEMENT IN HIGH SPEED INJECTION MOLDING APPARATUS AND METHOD FOR VENTING GAS IN THE HIGH SPEED INJECTION MOLDING APPARATUS

BACKGROUND OF THE INVENTION

The present invention relates to a gas venting arrangement in a high speed injection molding apparatus, and to a method for venting gas in the high speed injection molding apparatus. More particularly, the invention relates to a mechanism for driving a gas vent control valve and a method for driving the gas vent control valve for closing the valve at high speed and at a proper timing without any delay.

In an injection molding method such as a die-casting method, a molded product often contains voids in its interior due to injection of a molten metal into a mold cavity in which gases are extant. The gases are mingled with the molten metal and remain intact, so that resultant molded product does not have high quality.

In order to remove gas from the molded product, a gas vent passage is generally provided which is connected to the mold cavity so as to discharge gas in the cavity during injection molding. More specifically, a gas vent control valve is provided at the gas vent passage. The gas vent control valve is opened during injection molding so as to allow the gas to be discharged therethrough, and is closed so as to avoid leakage of the molten metal through the gas vent control valve.

In order to maximumly discharge the gas so as to provide a void-free molded product, the gas vent control valve should have to be opened as long as possible, yet the gas vent control valve should have to be closed before the molten metal reaches the valve so as to prevent the molten metal from passing therethrough.

More specifically, generally, a vacuum sucking system is disposed at downstream side of the gas vent control valve so as to positively suck gas within the mold cavity. In order to avoid leakage of the molten metal into the vacuum sucking system, the gas vent control valve must be closed before the molten metal splash reaches the valve. The molten metal splash may be generated because of the high speed injection, application to vacuum in the mold cavity and relatively small cross-sectional area of a gate portion of the mold cavity. On the other hand, if the gas vent control valve is closed at relatively early timing, sufficient gas venting cannot be performed, so that the final molded product may contain voids, to thus lower the quality. Therefore, the gas vent control valve must be closed at an optimum timing in order to maximumly discharge the gas within the mold cavity toward outside of the molding machine, yet to avoid leakage of the molten metal through the gas vent control valve before the molten metal splash reaches the valve, that is, the valve must be closed immediately before the molten metal splash passing through the gas vent passage reaches the valve.

According to a conventional gas venting arrangement, the molten metal within the mold cavity is detected, and the gas vent control valve is closed by pneumatic pressure in response to the detection signal. One example of such conventional arrangement is disclosed in Japanese Utility Model Application Kokai No. 61-195853.

FIGS. 1 thru 3 show the gas venting arrangement disclosed in this publication. A metal mold 1 includes a stationary mold half 2 and a movable mold half 3. Parting faces 4 of the mold halves 2 and 3 are formed with a mold cavity 5 and a gas vent passage 6 in fluid communication with the cavity 5. The gas vent passage 6 has relatively large inner diameter. A gate 7 is provided at upstream side of the mold cavity 5, and the gas vent passage 6 is formed at downstream side thereof. Distal end of the gas vent passage is open to the atmosphere. Alternatively, the distal end is connected to a vacuum sucking device 8 as shown for positively discharging gas in the mold cavity 5 toward outside of the metal mold 1. The vacuum sucking device 8 includes an electromagnetic change-over valve **8*a*, a tank 8*b*, a vacuum pump 8*c* and a motor 8*d***.

At the downstream end portion of the gas vent passage 6, there is provided a tapered gas vent control valve 9 for selectively opening the gas vent passage 6 to thus allow gas to discharge therefrom. Further, a detection member 10' is disposed at the gas vent passage 6 and at the upstream side of the control valve 9. The detection member 10' detects the molten material such as electrically conductive molten metal. When the molten material is brought into contact with the detection member 10', the detection member 10' detects the molten material and sends detection signal to an electric control means (not shown), and the electric control means sends instruction signal to a valve driving mechanism. The gas vent control valve 9 is moved in response to the operation of the valve driving mechanism.

The valve driving mechanism 12 shown in FIG. 1 includes a valve driving cylinder **12*d*, a piston 12*f* integrally connected to a valve head 9*a* of the gas vent control valve 9 and slidable in the valve driving cylinder 12*d*, an electromagnetic change-over valve 12*a* and a compressor 12C. The piston 12*f* divides the driving cylinder 12*d* into a front chamber 12*g* and a rear chamber 12*i*. The change over valve 12*a* provides first and second positions. In the first position, pneumatic pressure is positively applied to the front chamber 12*g* by the pneumatic drive means 12C to move the piston 12*f* toward the rear chamber 12*i*, so that the valve 9 closes a tapered valve seat 12*j*. In the second position of the change-over valve 12*a* (FIG. 1 shows the second position of the change-over valve 12*a*), pneumatic pressure is positively applied to the rear chamber 12*i* to urge the piston 12*f* toward the front chamber 12*g*, so that the valve head 9*a* is moved away from the valve seat 12*j***, to thereby allow gas to pass therethrough.

In this gas venting arrangement, if molten material were to reach the gas vent control valve 9 and be discharged therefrom prior to complete closing of the gas vent control valve 9 in response to the detection of the molten material by the detection member 10', it would be impossible to conduct subsequent injection molding operation. Therefore, it is necessary to retard the molten material in reaching the gas vent control valve 9 so that the vent control valve 9 is closed prior to the molten material reaching the valve 9. Therefore, after detection of the molten material by the detection member 10', sufficient time must be provided by delaying the molten material in reaching the valve 9. For this, in the above described arrangement, the gas vent passage 6 is in the form of net pattern **6*a* having a plurality of obstructing protrusions 6*b* as shown in FIG. 2. Alternatively, the gas vent passage 6 is in the form of meandering pattern 6*c* as shown in FIG. 3**.

Turning back to FIG. 1, a casting sleeve 14 formed with a casting port **14*a*** is fixed to the stationary mold half 2. The casting sleeve 14 communicates with a melt runner 13 separated from the mold cavity 5 by the gate 7. An injection cylinder 15 is provided with an injection plunger 16 extending from and retracting into the cylinder 15. The plunger 16 is integrally provided with a striker 17 abuttable against a limit switch 18 and a high-speed limit switch 19 during extension strokes of the plunger 16. The limit switch 18 is electrically connected to the electromagnetic change-over valve 8*a*, and the limit switch 19 is electrically connected, through an injection molding drive unit (not shown), to the injection cylinder 15. The molten material supplied into the casting sleeve 14 through the casting port 14*a* is introduced into the mold cavity 5 through the runner 13 and the gate 7 by the extension of the plunger 16. After the plunger 16 extends to close the casting port 14*a*, the striker 17 abuts against the limit switch 18, so that the electromagnetic change-over valve 8*a* is operated. As a result, gas in the mold cavity and the casting sleeve 14 is aspirated by the pump 8*c* and is discharged therefrom through the valve 9.

When the striker 17 abuts against the limit switch 19, the limit switch 19 generates an instruction signal to a driver unit (not shown) to operate the plunger 16 at high extension speed, so that high speed casting is attainable.

In operation, while the valve head 9*a* of the gas vent control valve 9 is spaced away from the valve seat 12*j*, the molten material is poured into the casting sleeve 14 through the casting port 14*a* and the casting cylinder 15 moves the plunger 16 toward the sleeve 14 and the plunger 16 closes the casting hole 14*a*. Thereafter, electromagnetic change-over valve 8*a* is operated upon abutment of the striker 17 to the limit switch 18. As a result, vacuum pump 8*c* is connected to the distal end of the gas vent passage 6 for discharging gas in the cavity 5 and the sleeve 14 from the metal mold 1. In this sequence, opening of the valve 9 is maintained.

When the plunger 16 further extends to completely fill the molten material into the mold cavity 5, the molten material may flow into the gas vent passage 6 and into contact with the detection member 10'. Upon contact, closed electrical circuit is provided, since the molten material is an electrically conductive material, and the member 10' issues a detection signal. Thus, the electromagnetic change-over valve 12*a* is operated or is moved to a first position by the detection signal. By the change-over operation of the valve 12*a*, the front chamber 12*g* of the valve driving cylinder 12*d* is connected to the compressor 12C, so that pneumatic pressure is applied to the front chamber 12*g*. As a result, the piston 12*f* is urged toward the rear chamber 12*i*, and the valve head 9*a* is seated onto the valve seat 12*j* for closing the valve 9. Therefore, leakage of the molten material from the metal mold 1 can be prevented. In this case, since the tapered valve 9 is seated on the tapered valve seat 12*j*, close contact therebetween is attainable to thus further ensure prevention of melted material from leakage. After the injection molding, the movable mold half 3 is separated from the stationary mold half 2, for removing the molded product. In this product removal, flushes can be also removed from the gas vent passage together with the casted product. Upon flash removal, the electrical control means is operated to operate the electro-magnetic change-over valve 12*a* into the second position shown in FIG. 1. As a result, pneumatic pressure is applied to the rear chamber 12*i* to move the piston 12*f* toward the front chamber 12*g*, to thereby move the valve head 9*a* away from the valve seat 12*j*. This is the reset position of the gas vent control valve 9.

Another conventional gas venting arrangement is disclosed in Japanese Patent Application Kokai No. 60-49852. In this arrangement, a gas vent valve is closable by the inertial force of molten material if the inertial force of the molten metal is sufficiently large, or by an actuator which responds to a signal from a temperature sensor which detects the metal mold temperature if the inertial force of the molten metal is small. When the metal mold temperature detected by the detector is lower than a preset temperature, an electrical signal is sent to the actuator. In operation, during ordinary metal injection, the metal mold temperature is higher than the preset value, such that an electromagnetic valve is not operated and the gas vent valve is closed by the inertia of the molten material. During an initial start-up period of or in special occasions where the molten metal temperature is lower than the preset value and accordingly, the molten metal does not provide large inertial force, the electromagnetic valve is actuated, resulting in closure of the valve. The sensor does not always control gas vent valve opening and closing.

Still another conventional gas venting arrangement is disclosed in East German Patent No. 146,152 which is directed to a seal for vacuum pressure die casting dies in which molten metal enters a riser. A contactor positioned within the riser is contacted by liquid metal rising in the die to close an electric circuit in which a relay is disposed for actuating a control magnet.

Still another conventional gas venting arrangement is disclosed in Japanese Patent Application Kokai No. 63-60059 in which a switching circuit is provided between a molten metal detection sensor and a drive means which drives a gas vent control valve, the drive means being one of an electromagentic valve and an electromagnetic coil.

According to the above described prior art, it would be almost impossible to promptly close the gas vent control valve instantaneously upon detection of the molten metal by the detection member. The reason therefor is summarized as follows;

(1) According to the conventional arrangement, it would be impossible to promptly generate detection signal indicative of the contact of the first molten metal splash with the detection member so as to promptly generate output signal for driving the valve driving mechanism. That is, when the molten metal is splashed, it intermittently contacts the detection member at high frequency. The molten metal is electrically conductive, so that splashed molten metal provides a pulsating voltage line or high frequency pulse as shown in FIG. 10 Section (I) at each detection of the molten metal. Here, it is quite important that the gas vent control valve must be immediately closed upon the first detection of the initial pulse (the first splashed molten metal). Otherwise the first splashed molten metal may pass through the gas vent control valve, which is extremely disadvantageous. In this regard, as soon as the detection member detects the first splashed molten metal, it is necessary to generate output signal in response to the molten metal detection signal for driving the valve driving mechanism in order to close the gas vent control valve. However, in the conventional arrangement, there were time lag for generating the output signal.

(2) According to the conventional arrangement, when the detection member detects the molten metal and send the detection signal to the electric circuit, the electric circuit generates an output signal for change-over operation of the electromagnetic valve, so that compressed air from the compressor is supplied to the valve driving cylinder. Therefore, the piston of the cylinder is displaced, so that the gas vent control valve connected to the piston rod is closed.

With the structure, operation of the valve driving mechanism requires a given time period after receiving the output signal, since the change over operation of the electromagnetic valve requires a predetermined time period. As a result, closing timing of the gas vent control valve may be retarded.

In another aspect of this type of technology, there has been drawbacks in the detection member itself. More specifically, in a conventional detection member (molten metal sensor) as shown in FIG. 4, a non-electrically conductive holder 10'e is fixedly supported to the metal mold 2, and, two electrically conductive pins 10'a and 10'b extend through the non-electrically conductive holder 10'e. End portions of these pins 10'a and 10'b are positioned at the gas vent passage 6 for detecting the molten metal. Further, an insulating member 10'c formed of a ceramic material is provided to close the holder 10'e. The insulating member 10'c fluid tightly secures these pins 10a 10'b in order to prevent the molten metal from entering into the interior of the holder 10'e. At another end portions of the pins, another insulating member 10'd is provided.

Before the molten metal reaches the pins, these pins 10'a and 10'b are electrically insulated from each other. However, if the molten metal reaches these pins, these pins are electrically connected with each other, so that molten metal detection is carried out. The lines 10'f and 10'g are connected to the pins 10a and 10b, respectively, which lines are connected to electric control means for driving the valve driving mechanism.

According to the conventional detection member, when the electrically conductive pins 10'a and 10'b are contacted with the molten metal, the temperature of the pins are elevated, and the pins are thermally expanded. In this case, since the insulating member 10'c sealingly maintain the electrically conductive pins 10'a and 10'b for avoiding entry of the molten metal into the holder 10'e, the insulating members 10'c and 10'd may be broken due to difference in thermal expansion coefficients between the metallic pins 10'a 10'b and the insulating members 10'c 10'd. (The thermal expansion coefficient of the pins is higher than that of the insulating members). In order to avoid this drawback, space may be provided between the pins and the insulating members. However, then, the molten metal may be entered through the space, so that electrically insulating function is degraded or negated.

SUMMARY OF THE INVENTION

The present invention has been established for avoiding the leakage of the molten metal from a gas vent control valve in high speed injection of the molten metal. In the high speed injection, the molten metal may be dispersed and scattered in the splashed forms, and such splashed molten metal must be promptly detected for generating detection signal and such detection signal must be promptly transmitted to a valve driving mechanism for closing the gas vent control valve for avoiding leakage of the molten metal splash therethrough.

During high speed injection, the high initial speed of the molten metal is further accelerated if the molten metal is passed through a gate of reduced cross-sectional area (such as a gate 7 in FIG. 1). Typical plunger speed for low speed injection range from 0.2 to 0.4 m/sec, whereas those for high speed injection range from about 0.8 to 2.0 m/sec. As the molten metal passes through areas of reduced cross-sectional area, the speed of the molten metal is increased to as high as about 30 to 50 m/sec. As a result, the molten metal flow is turbulent and may be splashed upward at high speed.

Moreover, the provision of a vacuum sucking device further increase the tendency of the injected molten metal to be splashed. Negative pressure is applied to the mold cavity by a vacuum sucking device 8 (FIG. 1) which is connected downstream end of the gas vent passage 6 (downstream of the gas vent control valve 9) to positively suck the gas from within the mold cavity 5. The use of such vacuum facilitates the production of a void free product. The vacuum tends to pull the molten metal upward, and since there is less gas in the cavity 5 due to the applied vacuum, resistance to flow of the molten metal due to that gas is reduced.

Copending U.S. patent application Ser. No. 128,185 has been filed on Dec. 3, 1987 for overcomming the problem (1) described above. In the copending application, the flip-flop circuit is provided which provides prompt output signals simultaneously with the edge detection of voltage (which is indicative of the first contact of the first molten metal splash with the detection member) so as to actuate the electromagnetic valve and to maintain that signal to continue actuation of the valve for a given period. However, in the present invention, further improvements have been made for increasing closing speed and timing of the gas vent control valve upon first detection of the first molten metal splash by the detection member.

In the gas venting arrangement in which compressed air is used to perform closing operation of the gas vent control valve, for the purpose of avoiding molten metal leakage into the gas vent control valve, the electromagnetic valve must rapidly perform its change-over operation so as to promptly supply large volume of the compressed air to the valve driving cylinder in order to close the gas vent control valve at high speed.

In order to supply large volume of the compressed air into the valve driving cylinder, large electromagnetic valve must be used. However, generally, from 10 to 30 milliseconds is required for change-over operation of the large electromagnetic valve. During this change-over period, molten metal may be leaked into the gas vent control valve, since sufficient pneumatic pressure has not been generated within the valve driving cylinder connected to the gas vent control valve.

On the other hand, if high voltage is applied to such large elecromagnetic valve which voltage is several times as large as a rated voltage thereof, change-over operation can be achieved within much shortened period. However, such high voltage application to the electromagnetic valve may lead to burning of a coil of a solenoid.

If small size electromagnetic valve is used instead of the large electromagnetic valve, change over operation can be made within shortened period. However, only a limited volume of the compressed air can be supplied to the valve driving cylinder, and therefore, a long time is required for generating sufficient pressure within the valve driving cylinder for finally closing the gas vent control valve.

It is therefore, an object of the present invention to overcome the above described drawbacks and disadvangates, and to provide an improved gas venting arrangement in high speed injection molding apparatus and to provide a method for venting gas in the high speed injection molding apparatus.

Still another object of this invention is to provide such improved gas venting arrangement and the improved gas venting method in which a valve driving mechanism can provide prompt change over operation in response to a first detection of a first molten metal splash by a detection member so as to promptly supply large volume of compressed air to a valve driving cylinder in order to close a gas vent control valve at high speed with no delayed timing.

Still another object of this invention is to provide such improved gas venting arrangement and the method for the gas vent which are available for extremely high speed injection molding.

Still another object of this invention is to provide an improved molten metal detection member or sensor used in the gas venting arrangement in accordance with this invention and which sensor can obviate damage to an insulating member and to provide a prolonged service life.

With the above in view, according to the present invention, a small size electromagnetic valve is used which is capable of flowing small amount of compressed air therethrough, and which is capable of performing high speed change over operation. Further, a large pneumatically operated valve is used which is capable of allowing large volume of compressed air to pass therethrough, and which performs change-over operation by the quick change over operation of the small size electromagnetic valve. Furthermore, the small size electromagnetic valve is applied with high voltage signal for a short period indivative of the molten metal detection, which high voltage is several times as large as a rated voltage of the small size electromagnetic valve.

Since the electromagnetic valve has a small mass, and since the high voltage whose level is several times as large as the rated voltage thereof is applied to the electromagnetic valve, it can perform prompt change over operation so as to promptly supply small amount of compressed air to the pneumatically operated valve. Further, since the pneumatically operated valve connected to the compressor can pass large volume of compressed air therefrom, the small amount of compressed air functions as a starter so as to perform change-over operation of the pneumatically operated valve. When the pneumatically operated valve is changed over, large volume of compressed air is supplied to the valve driving cylinder. Therefore, the gas vent control valve is promptly moved to its closing position.

Briefly, and in accordance with the present invention, there is provided a gas venting arrangement in an injection molding apparatus which includes a casting sleeve, mold halves defining a mold cavity therebetween, an injected molten metal being fed through the casting sleeve and molded within the mold cavity, the mold halves being formed with a gas vent passage in fluid communication with the mold cavity and positioned downstream side with respect thereto, and, a gas vent control valve disposed at a downstream end portion of the gas vent passage; the gas venting arrangement comprising: a detection member for detecting the molten metal and generating a detection signal; control circuit connected to the detection member, the control circuit generating a high voltage drive signal in response to the detection signal; a valve driving mechanism having one end connected to the control circuit and another end connected to the gas vent control valve, the valve driving mechanism comprising a pneumatic source, an electromagnetic valve connected to the pneumatic source and performing change over operation in response to the drive signal, and a pneumatically operated valve connected to the pneumatic source and having one end connected to the electromagentic valve and another end connected to the gas vent control valve, the pneumatically operated valve performing change-over operation in response to the change over operation of the electromagnetic valve for applying pneumatic pressure in the pneumatic source to the gas vent control valve to move the gas vent control valve to its close position.

Further, in accordance with the present invention there is provided a method for venting gas in a high speed injection molding apparatus which includes a casting sleeve, mold halves defining a mold cavity therebetween, an injected molten metal being fed through the casting sleeve and molded within the mold cavity, the mold halves being formed with a gas vent passage in fluid communication with the mold cavity and positioned downstream side with respect thereto, and, a gas vent control valve disposed at a downstream end portion of the gas vent passage; the method comprising the steps of: detecting the molten metal by a detection member provided in the gas vent passage, sending to a control circuit a first detection signal indicative of first detection of the first molten metal detected by the detection member; generating a high voltage drive signal at the control circuit; outputting the high voltage drive signal to an electromagnetic valve for its prompt change over operation; performing change over operation of a pneumatically operated valve in response to the change over operation of the electromagnetic valve for moving the gas vent control valve to its close position.

DETAILED DESCRIPTION OF THE PREFERRED EMBODIMENT

Figure 1:
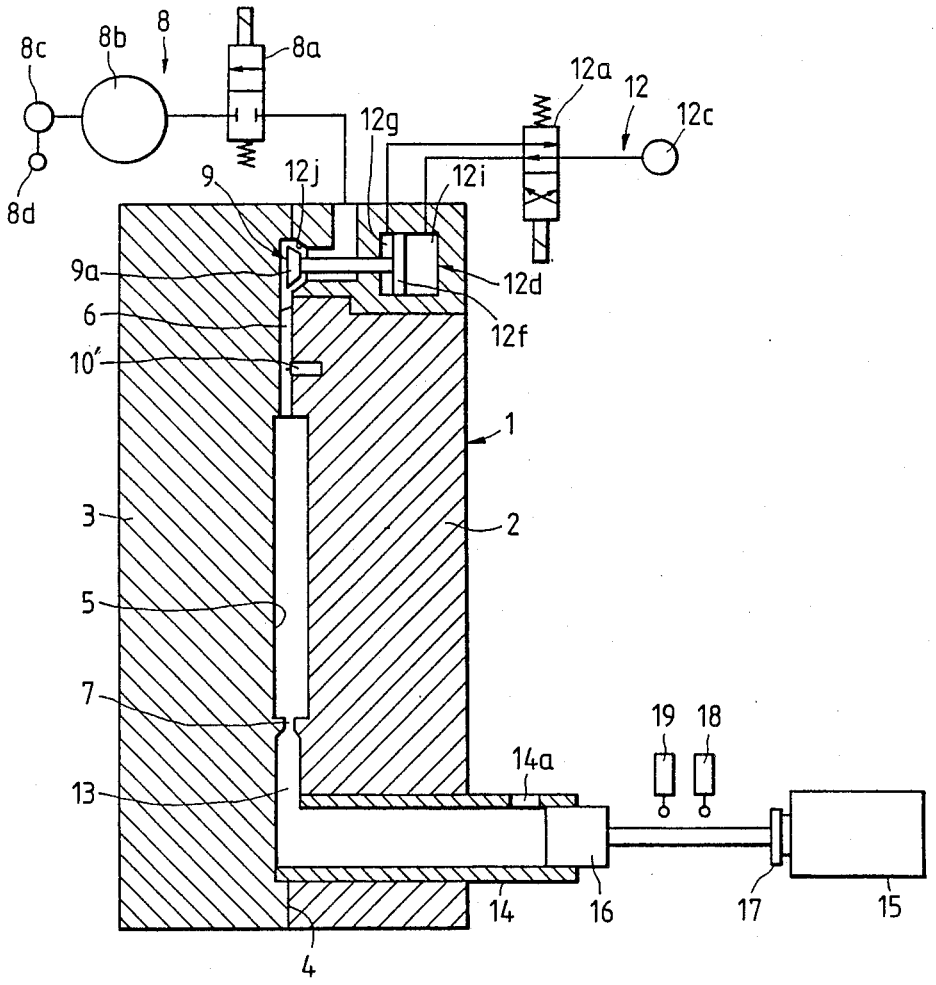
FIG. 1 PRIOR ART
FIG. 1 is a cross-sectional view showing a gas venting arrangement according to a conventional injection molding apparatus.
Figure 2:
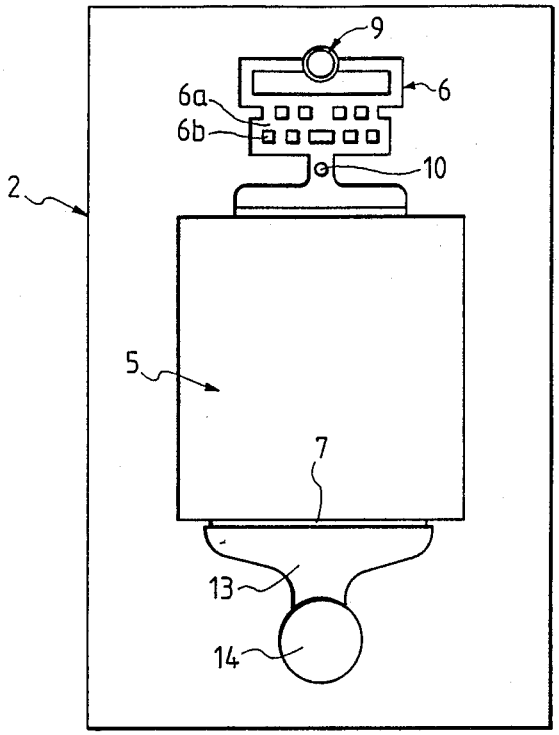
FIG. 2 PRIOR ART
FIG. 2 is a front view of a stationary mold half of the injection molding apparatus shown in FIG. 1.
Figure 3:
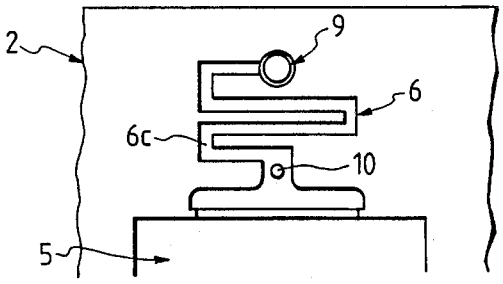
FIG. 3 PRIOR ART
FIG. 3 is a front view showing a modified arrangement in a stationary mold half.

A gas venting arrangement according to a present invention will be described with reference to FIG. 6 wherein like parts and components are designated by the same reference numerals and charactors as those shown in FIG. 1.

In the present invention contemplated are more rapid closure of the gas vent control valve 9 in response to the detection of the molten metal by the detecting member 10 so as to cope with much higher speed of molten metal injection, and much more gas venting capability for complete prevention of voids in the casted product.

For this, taking particularly the problem (2) described above into consideration, in the present invention, there is provided an improved valve driving mechanism which can be rapidly operated in response to a first molten metal detection signal.

General gas venting arrangement in an injection molding apparatus will be briefly described with reference to FIG. 6. This general arrangement is almost the same as that shown in the copending U.S. patent application Ser. No. 128,185.

Figure 6:
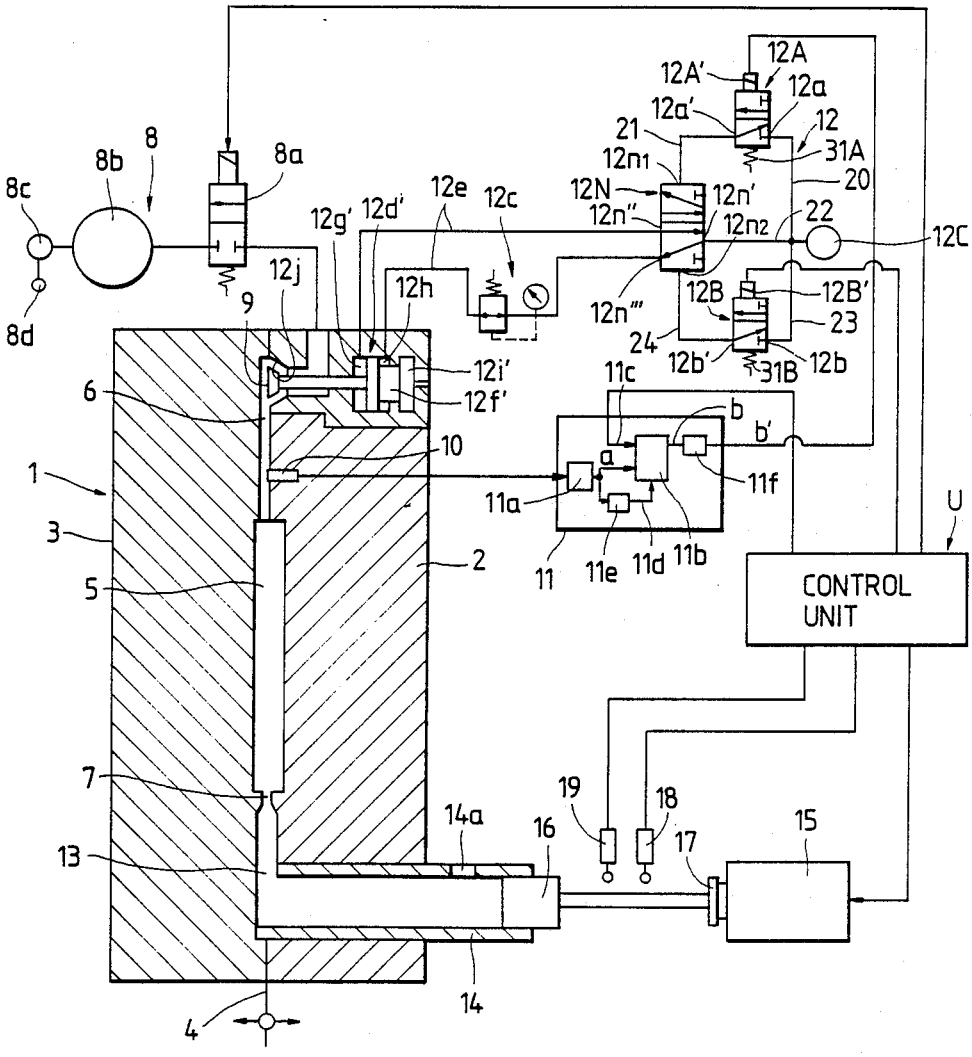
FIG. 6 is a cross-sectional view showing a gas venting arrangement incorporating a valve driving mechanism according to a second embodiment of this invention used in an injection molding apparatus.

As shown in FIG. 6, a gas vent passage 6 in communication with a mold cavity 5 is provided at a parting faces of the stationary metal mold 2 and the movable metal mold 3. The gas vent passage 6 is provided at a position opposite a gate 7 with respect to the mold cavity 5. External end of the gas vent passage 6 is connected to a vacuum sucking device 8 or is opened to atmosphere, so that gas within the mold cavity can be discharged therefrom during injection molding. At the external end portion of the gas vent passage 6, a gas vent control valve 9 is provided which is driven by a valve driving mechanism 12. Further, a detection member 10 for detecting an electrically conductive molten metal is provided at the gas vent passage 6. The detection member 10 is connected to the valve driving mechanism 12 through a control circuit 11. The position of the detection member 10 is not limited to the gas vent passage 6. The detection member 10 can be disposed within the metal mold cavity 5, or at a runner 13. Further, a plurality of detection members can be provided.

The control circuit 11 includes a filter circuit 11*a*, a timer 11*e*, an electronic circuit 11*b* and a drive circuit 11*f*. In the electronic circuit 11*b*, various types are available such as a flip-flop circuit which is particularly described in the copending U.S. patent application Ser. No. 128,185. The flip-flop circuit belongs to a multivibrator in which either of the two active devices may remain conducting, with the other nonconducting, until the application of an external pulse, and also known as bistable multivibrator, Eccles-Jordan circuit, Eccles-Jordan multivibrator and trigger circuit. Further, monostable multi-vibrator, IC timer or circuit, and a trigger circuit are also available as the electronic circuit 11*b*. Further, instead of the electronic circuit, an electric circuit such as a relay circuit and solenoid is also available in the present invention because of an improved valve driving mechanism.

In FIG. 6, the filter circuit 11*a* or a wave form shaper is adapted to remove noise, and the electronic circuit 11*b* is adapted for providing an output signal instantaneously upon detection of injected material by the detection member 10 in order to actuate the valve driving mechanism 12, and for maintaining the output signal in order to maintain actuation of the valve drive mechanism 12.

When the flip flop circuit is used as the electronic circuit 11*b*, as soon as the detection member detects the first splashed molten metal, the flip-flop circuit 11*b* detects a leading edge voltage (signal a) indicative of the first contact of the intial splashed molten metal with the detection member. The flip-flop circuit provides prompt output signal b simultaneously with the edge detection of voltage so as to actuate the valve driving mechanism 12 and to maintain that signal to continue actuation of the valve driving mechanism 12 for a given period.

The drive circuit 11*f* is adapted to generate a high voltage drive signal b' in response to the output signal b from the electronic circuit 11*b*.

The timer circuit 11*e* is connected between the filter circuit 11*a* and the flip-flop circuit 11*b*. The timer circuit 11*e* is operated in response to the detection signal a, and generates a reset signal 11*d* after short elapse of time, so as to reset the flip flop circuit 11*b*. By this resetting, the output signal b from the flip flop circuit 11*b* is changed from high level to low level.

The valve driving mechanism 12 is adapted to operate a gas vent control valve 9, and is operated upon receiving the output drive signal b' from the control circuit 11. Details of the valve driving mechanism 12 will be described later.

The flip-flop circuit 11*b* as best shown in FIG. 6 is also connected to an electrical control unit U for receiving a signal 11c therefrom. The signal 11c is indicative of the initial start-up of casting the molten material into the casting sleeve 14. By the activation of a limit switch 18 caused by abutment with a striker 17, the signal 11c is sent from the control unit U to the electronic circuit 11b. The signal 11c is generated upon actuation of the limit switch 18 so as to provide stand-by or enable signal to the flip-flop circuit 11b. The flip-flop circuit 11b maintains melted material detection state even by instantaneous detection thereof by the detection member 10, to thus ensure operational state of the electromagnetic valve 12A.

The signal 11d is a reset signal and is generated after elapse of short period counting from an input timing of the molten metal detection signal a for resetting output signal sent from the flip-flop circuit 11b. For example, the timer 11e is connected to a clear (CL) terminal of the flip flop circuit 11b. The timer 11e is actuated in response to the detection signal a from the detection member 10, and generates an output signal 11d to the clear terminal of the flip flop circuit 11b after elapse of predetermined period of time, so that the sending of the output signal from the flip-flop circuit 11b to the electromagnetic valve 12A is terminated. As a result, the electromagnetic valve 12A restores its original position shown in FIG. 6 by the biasing force of the spring 31A.

Figure 7:
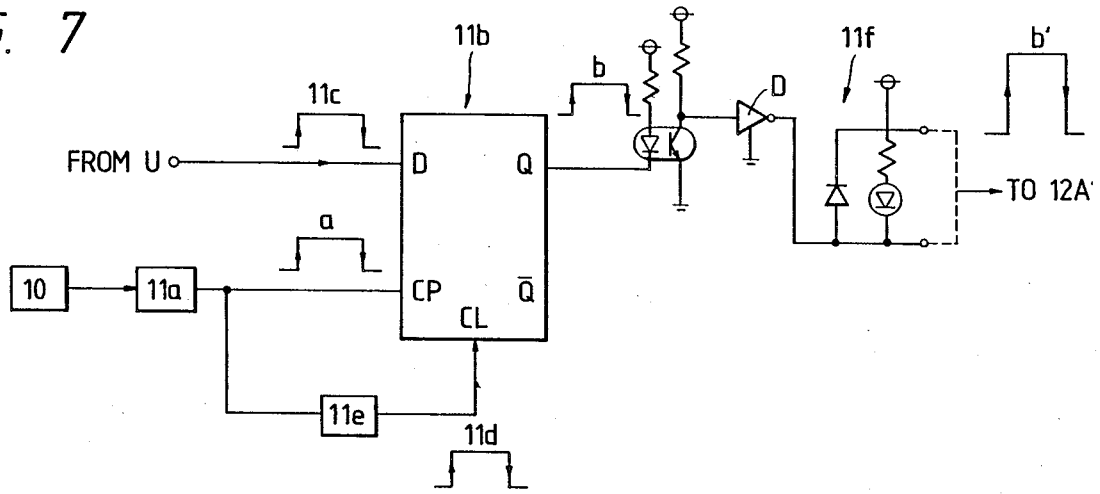
FIG. 7 is a schematic view showing an electronic circuit used in this invention.

Details of the electronic circuit 11b will be described with reference to FIG. 7.

D terminal of the flip-flop circuit 11b is connected to the control unit U, and Q terminal is connected to the drive circuit 11f. Further, CP terminal is connected to the detection member 10 and CL terminal is connected to the timer 11e. When the striker 17 abuts the limit switch 18, the control unit U sends signal 11c to the D terminal, so that the D terminal is changed to high level to thereby provide stand-by state of the flip-flop circuit 11b. When the detection member 10 detects the first molten metal splash, the detection signal a is sent to CP terminal, and at the same time the timer 11e connected to the clear (CL) terminal is actuated in response to the detection signal a. When the signal a is applied, a voltage level of the CP terminal is changed from low to high, so that the voltage level of Q terminal is changed from low to high. Even after the voltage level of CP terminal becomes low (since the molten metal is not continuously contacted with the detection member but is intermittently contacted therewith), the high voltage level at the Q terminal can be maintained to perform a memory function. After short elapse of time, the timer 11e generates the output signal 11d to the CL terminal for resetting the flip flop circuit 11b, so that the output signal b is changed from high level to low level.

Figure 8:
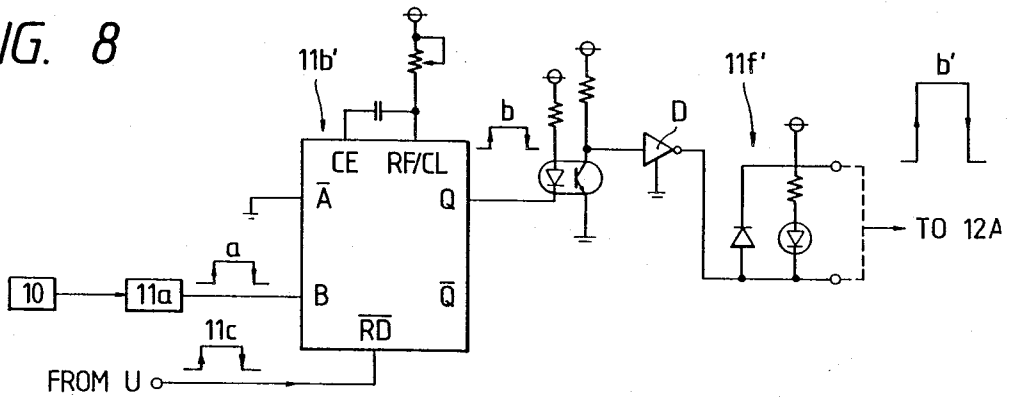
FIG. 8 is a schematic view showing another electronic circuit used in this invention.

FIG. 8 shows another example of the electronic circuit 11b'. In this example, a monostable multibivrator is used. The monostable multibivrator 11b' is connected to a drive circuit 11f' as shown. B terminal is connected the the detection member 10 through the filter 11a, so that the molten metal detection signal a is applied to the B terminal. Q terminal is connected to the drive circuit 11f' which is connected to the solenoid 12A' of the electromagnetic valve 12A. When the detection signal a is applied to the B terminal, a signal b is outputted from the Q terminal, so that high voltage drive signal b' is applied to the solenoid 12A' from the drive circuit 11f'. CE terminal and RE/CE terminal are connected to a capacitor and a resistor. Upon application of the detection signal a, these terminals generate output signal b for a short period, and after elapse of the short period, the signal b is automatically changed from high level to low level. RD terminal is connected to the control unit U for receiving the signal 11c therefrom. Owing to this signal 11c, the monostable multibivrator 11b' can have a stand-by state for enabling prompt operation. With the structure, the timer 11e in the FIG. 7 embodiment can be dispensed with. After inputting the detection signal a, even without the reset signal 11d, the output signal b can be automatically changed to low level after elapse of short period. Incidentally, Eccles-Jorden circuit and a trigger circuit are available instead of the flip-flop circuit and the mono-statable multibivrator.

A valve driving mechanism according to a first embodiment will next be described with reference to FIG. 5.

The valve driving mechanism 12 is adapted to operate a gas vent control valve 9, and is operated upon receiving the output drive signal b' from the control circuit 11.

Figure 5:
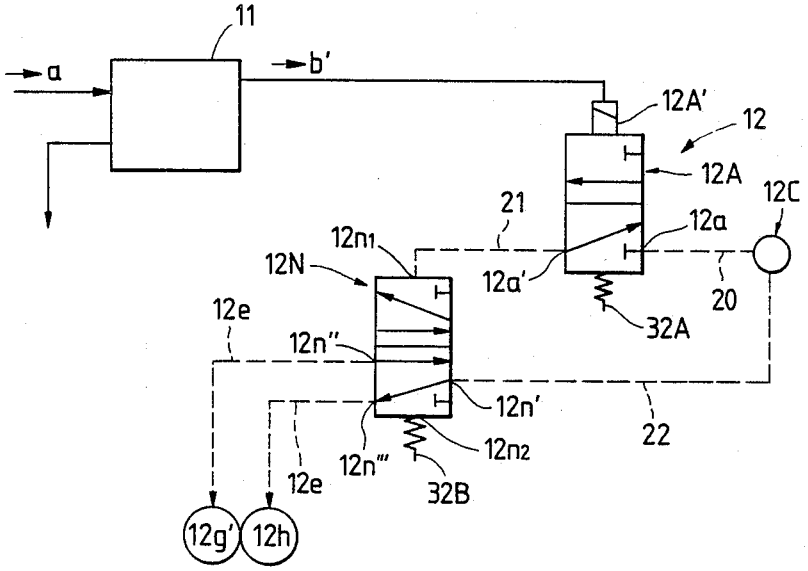
FIG. 5 is a schematic illustration showing a valve driving mechanism according to a first embodiment of this invention.

As shown in FIG. 5, the valve driving mechanism according to a first embodiment, there is further provided a pneumatically operated valve 12N. According to the conventional valve driving mechanism shown in FIG. 1, the pneumnatic pressure in the compressor 12C is applied to the front chamber 12g through the electromagnetic valve 12a only. However, in the conventional arrangement, the change over operation of the valve 12a requires a relatively long period, so that closing timing of the gas vent control valve 9 is retarded. In contrast, according to this invention, high speed closing operation of the valve 9 is attainable because of the employment of an electromagnetic valve 12A and the pneumatically operated valve 12N.

More specifically, the electromagnetic valve 12A is provided with a solenoid 12A' which is connected to the driving circuit 11f for receiving high voltage signal b'. The valve 12A has an intake port 12a connected to the compressor 12C by way of a line 20, and has an outlet port 12a' connected to the pneumatically operated valve 12N through a line 21. The pneumatically operated valve 12N has a first intake port 12n1 connected to the line 21, and a second intake port 12n' connected to the compressor 12C through a line 22. The valve 12N is also provided with outlet ports 12n'' and 12n''' each selectively connectable with one of the front chamber 12g' and the intermediate chamber 12h (see FIG. 6). A spring 32A is connected to the electromagnetic valve 12A for urging the valve 12A to a second position, and a spring 32B is connected to the valve 12N for urging the same to a second position where the pneumatic pressure is applied to the intermediate chamber 12h. In the state shown in FIG. 5, the electromagnetic valve 12A and the pneumatically operated valve 12N are at their second positions because of the biasing force of springs 32A and 32B. In this state, the intake port 12n' is connected to the outlet port 12n''', so that the compressed air from the compressor 12C is supplied to an intermediate chamber 12h (see FIG. 6), whereby the gas vent control valve 9 is opened.

When the detection member 10 detects the first molten metal splash and generates a detection signal a, the flip-flop circuit 11b promptly generates the output signal b to the driving circuit 11f, so that the circuit 11f generates high voltage drive signal b' whose voltage level is several times as large as a rated voltage of the electromagnetic valve 12A. Therefore, because of the application of high voltage to the valve 12A, it provides prompt change over operation, so that it moves to its first position where the outlet port 12a' of the valve 12A is connected to the intake port 12n1 of the valve 12N. As a result pneumatic pressure from the compressor 12C is supplied to the intake port 12n1 of the pneumatically operated valve 12N through the valve 12A, so that the valve 12N is moved to its first position against the biasing force of the spring 32B where the intake port 12n' is connected to the outlet port 12n''. Therefore, a large volume of the compressed air from the compressor 12C can be delivered into the front chamber 12g' (see FIG. 6) through the intake port 12n' and the outlet port 12n''.

It should be noted that since the high voltage signal whose voltage level is several times as large as the rated voltage of the electromagnetic valve 12A, the valve 12A can provide prompt change over operation. Further, since the valve 12A has a small mass, it can be promptly moved to its first position. The pneumatic air is supplied into the pneumatically operated valve 12N through the electromagnetic valve 12A, and the valve 12N can be promptly moved to its first position. In this connection, the pneumatic pressure supplied from the electromagnetic valve 12A into the valve 12N functions as a trigger or starter. When the pneumatically operated valve 12N is changed to its first position by the application of small volume of the compressed air, large volume of the compressed air is supplied into the front chamber 12g'. Therefore, the gas vent control valve 9 (FIG. 6) is promptly closed.

A valve driving mechanism according to a second embodiment will next be described with reference to FIG. 6, in which additional electromagnetic valve 12B is provided instead of the spring 32B in the first embodiment. The valve driving mechanism 12 includes a first electromagnetic valve 12A having a first solenoid 12A', a second electromagnetic solenoid 12B having a second solenoid 12B', a pneumatically operated valve 12N, and a pressure control valve 12c. The mechanism also includes a compressor 12C, a valve driving cylinder 12d', a piston 12f', similar to the construction shown in FIG. 1. The pressure control valve 12c is connected to an associated pressure line 12e. The piston 12f' defines an intermediate chamber 12h in addition to front and rear chambers 12g' and 12i'. The intermediate chamber 12h is in fluid communication with the pressure control valve 12c. When the compressor 12C is connected to the intermediate chamber 12h through the pressure control valve 12c, pneumatic pressure in the intermediate chamber 12h prevents the gas vent control valve 9 from being moved toward a valve seat 12j. In other words, the intermediate chamber 12h is adapted to prevent the valve 9 from its closure at early stage, and the pressure control valve 12c serves to supply a controlled amount of pressure into the chamber 12h for controlling repulsive force against closing of the valve 9.

The first solinoid 12A' of the first electromagnetic solenoid 12A is connected to the control circuit 11, i.e., the drive circuit 11f, so that high voltage is applied to the solenoid 12A'. More specifically, upon detection of the molten metal by the detection member 10, this detection signal a is transmitted to the electronic circuit 11b, and the circuit 11b generates output signal b to the drive circuit 11f. The drive circuit 11f generates the output drive signal b' for a short period whose voltage is several times as high as a rated voltage of the electromagnetic valve 12A. Assuming that the rated voltage of the valve 12A is 5 volts, the drive signal b' has a voltage of 24 V. Therefore, the first electromagnetic valve 12A is moved to a first position upon receipt of the high voltage drive signal b'.

The second solenoid 12B' of the second electromagnetic valve 12B is connected to the control unit U. After the removal of the flush from the mold cavity, the second electromagnetic valve 12B' is moved to a first direction in response to a signal sent from the control unit U. First and second springs 31A and 31B are connected to the first and second electromagnetic solenoids 12A 12B, respectively so as to urge these to their original positions.

Intake ports 12a and 12b of the first and second electromagnetic valves 12A 12B are connected to the compressor 12C through pneumatic pressure lines 20 and 23, respectively. Further, the pneumatically operated valve 12N has a first pilot 12n1 which is connected to an outlet port 12a' of the first electromagnetic valve 12A by way of a line 21, and has a second pilot 12n2 which is connected to an outlet port 12b' of the second electromagnetic valve 12B by a line 24. Therefore, the pneumatically operated valve 12N can perform change over operation in response to the selective application of pneumatic pressure from one of the valves 12A and 12B.

An intake port 12n' of the pneumatic pneumatically operated valve 12N is connected to the compressor 12C by way of a line 22. When the pneumatically operated valve 12N is moved to a first position, large volume of compressed air can be supplied into the front chamber 12g' for closing the gas vent control valve 9. Here, the first electromagnetic valve 12A has a small internal volume, and high voltage which is several times as large as the rated voltage of the valve 12A is applied to the valve 12A. Therefore, the electromagnetic valve 12A can provide prompt change over operation in response to the output drive signal b', so that the pneumatically operated valve 12N can be promptly moved to its first position. The urging force from the first electromagnetic valve 12A to the pneumatically operated valve 12N can function as a starter, so that large volume of compressed air can be promptly supplied into the front chamber 12g' to thus close the gas vent control valve 9 at high speed.

In operation, FIG. 6 shows the state prior to casting of molten material into the casting sleeve 14 through the casting port 14a. Starting from this state, the molten material is casted into the sleeve 14 and the plunger 16 moves frontwardly to urge the molten material toward the mold cavity 5. In this instance, the striker 17 abuts the limit switch 18, and the electrical control unit U receives the signal which indicates initiation of the casting, and the signal is outputted into the D-terminal of the flip-flop circuit 11b as the output signal 11c. This signal 11c serves to provide the stand-by or enable state of the flip-flop circuit 11b for its prompt operation required in the subsequent output operation to the electromagnetic valve 12A. This signal 11c can be generated during injection of the molten metal into the mold cavity 5. When the striker 17 abuts the limit switch 18, the vacuum sucking device 8 is also actuated for starting vacuum sucking operation relative to the mold cavity 5.

Figure 4:
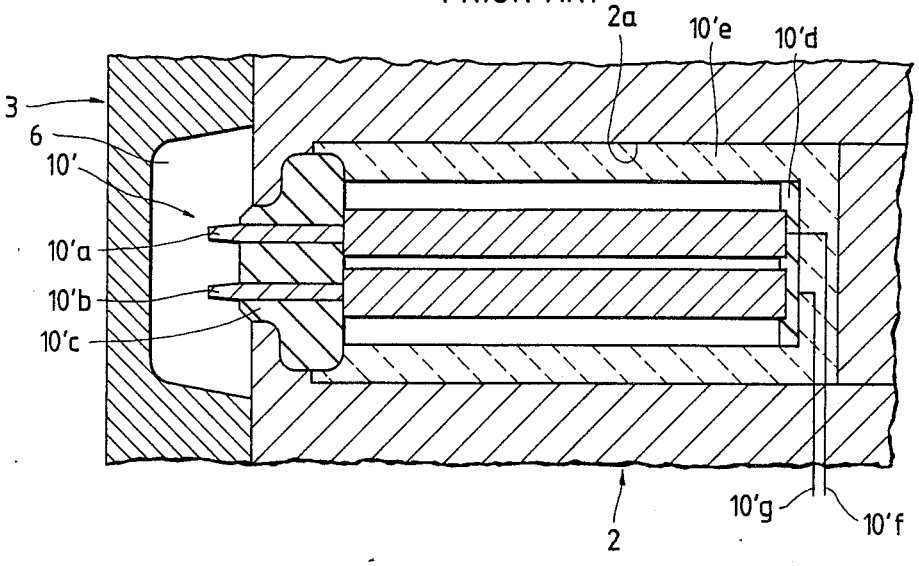
FIG. 4 PRIOR ART
FIG. 4 is a cross-sectional view showing a conventional detection member.

When the striker 17 abuts the high speed limit switch 19, high speed injection of the molten metal into the mold cavity 5 is started. In this instance, if part of the injected molded material is scattered through the gas vent passage 6 and makes contact with the detection member 10 during material injection process into the mold cavity 5, or if the molten material is pulsatingly advanced through the passage 6 as shown in section (I) of FIG. 10 (described later) and is brought into contact with the detection member 10 after complete or incomplete filling of the material into the cavity 5, the detection member 10 detects the molten metal since electrical currtent flows through the electrically conductive pins (see FIG. 4). In this case, the flip flop circuit **11*b* of the control circuit 11 detects a leading edge voltage indicative of the first contact of the initial splashed molten metal with the detection member, and the circuit can provide prompt output signal b simultaneously with the edge detection of voltage. In response to this output signal b, the drive circuit 11*f* generates the high voltage drive signal b' and at the same time, the timer 11*e* is actuated. This high voltage which is several times as large as the rated voltage of the electromagnetic valve 12A is applied to the first solenoid 12A' of the first electromagnetic valve 12A so as to actuate the electromagnetic valve 12A for a predetermined short period defined by the timer 11*e*. Since the electronic circuit 11*b* is rapidly operated, the electromagnetic valve 12A is moved from a second position to a first position to thereby move the pneumatically operated valve 12N to its first position, to thereby close the gas vent control valve 9. According to this embodiment, high output voltage of 24 volts are applied to the first electromagnetic valve 12A whose rated voltage is 5 volts. The duration of the high voltage signal is determined so as to prevent the first solenoid 12A'** from burning out.

In response to the application of high voltage to the first solenoid 12A', the electromagnetic valve 12A is promptly shifted to the first position, so that high pneumatic pressure from the compressor 12C is supplied to the pilot **12*n*1 of the pneumatically operated valve 12N through the outlet port 12*a*'. Therefore, the pneumatically operated valve 12N undergoes prompt change over operation. This high speed change over operation can be made even by the application of small volume of pressurized air (for example, 5 kg/cm$^2$) into the pilot 12*n*1. Therefore, large volume of pnuematic pressure is promptly supplied from the compressor 12C into the front chamber 12*g*' of the valve driving cylinder 12*d*' through the outlet port 12*n*''. On the other hand, compressed air within the intermediate chamber 12*h* can be discharged toward atmosphere through the pneumatically operated valve 12N. As a result, the gas vent control valve 9 can be seated onto the valve seat 12*j*** at high speed for completing the valve closure.

After injection molding, the vacuum sucking device 8 is deenergized, and the movable mold half 3 is separated from the stationary mold half 2 in response to a signal sent from the electrical control means U, and flush is removed simultaneous with the removal of the molded product. After this flush removal, the control unit U send a signal to the second solenoid 12B' of the second electromagnetic valve 12B, so that the electromagnetic valve 12B is moved. Further, the control unit U outputs the reset signal **11*d* to the D terminal of the flip-flop circuit 11*b*, so that the the stand-by state of the flip-flop circuit 11*b* is released. By the change-over operation of the second electromagnetic valve 12B, compressed air from the compressor 12C is supplied into the pilot 12*n*2 of the pneumatically operated valve 12N through the outlet port 12*b*', so that the pneumatically operated valve 12N is moved to its second position shown in FIG. 6. By this movement, compressed air from the compressor 12C is applied to the pressure control valve 12*c*, and therefore, a controlled pressure is applied to the intermediate chamber 12*h* of the valve driving cylinder 12*d*' through the outlet port 12''' of the pneumatically operated valve 12N. On the other hand, compressed air within the front chamber 12*g*' is discharged toward atmosphere through the valve 12N. Accordingly, the gas vent control valve 9 is opened for providing a stand by state of the valve 9** with respect to the next injection molding operation.

Figure 9:
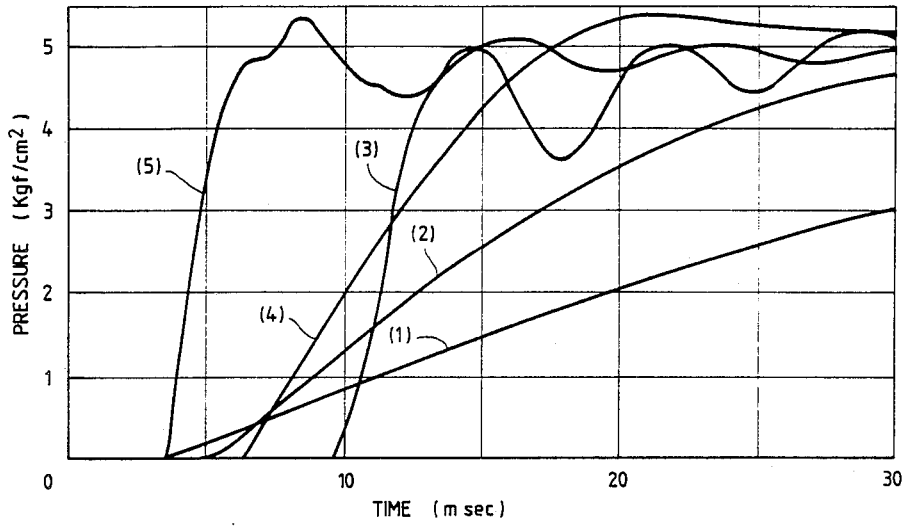
FIG. 9 is a graph showing operation modes of a valve driving mechanism.

FIG. 9 shows operation modes of components used in the valve driving mechanism, i.e., the operation modes of the electromagnetic valve 12A and the pneumatic pneumatically operated valve 12N. Various types of the electromagnetic valves and pneumatically operated valves were employed as testing samples in order to demonstrate superiority attendant to the co-use of the valves 12A and 12N.

Testing samples are shown in the table 1 below.

TABLE 1

| No. | Electro-magnetic valve | Effective cross-section (mm$^2$) | Voltage (V) | Manufacturer |
|---|---|---|---|---|
| 1. | 010E1 | 0.2 | DC 24 | Koganei Ltd. |
| 2 | 030E1 | 0.6 | AC 100 | Koganei Ltd. |
| 3. | 300E1 | 25.0 | AC 100 | Koganei Ltd. |
| 4. | 010E1 | 0.2 | DC 5 | Koganei Ltd. |
| plus | 110-4A2 | 4.2 | | Koganei Ltd. |
| 5. | 010E1 | 0.2 | DC 20 | Koganei Ltd. |
| plus | 110-4A2 | 4.2 | | Koganei Ltd. |

Note:
110-4A2 was the change over valve corresponding to the valve 12N

A container (which may correspond to the front chamber **12*g*') having an internal volume of 0.7 cc was connected to the outlet port of the electromagnetic valve. In case of the sample numbers 4 and 5, the container was connected to the electromagnetic valve by way of the change over valve (110-4A2). A constant compressed air having pressure of 5 kgf/cm$^2$ was applied to the electromagnetic valve. After energization of the electromagnetic valve, pressure change within the container was measured, and test results were represented in a graph shown in FIG. 9**.

As is apparent from the graph, in case of the samples 1 and 2, pressure increasing timing were started at relatively early timing. However, it took long time to obtain a predetermined internal pressure within the container. In case of the sample 3 where large effective cross-sectional area of the electromagnetic valve was provided, pressure increasing timing was extremely delayed. In case of sample 4 where the electromagnetic valve and the pneumatically operated valve were co-used whereas applied voltage to the electromagnetic valve was small (which voltage was almost equal to the rated voltage of the electromagnetic valve), pressure increasing timing was relatively delayed, and pressure increasing speed was also low. On the other hand, with respect to the sample 5 where the applied voltage was several times as large as the rated voltage of the electromagnetic valve, pressure increasing timing was started at early stage, and further, pressure increasing speed was also high.

Therefore, the co-use of the electromagnetic valve 12A and the pneumatically operated valve 12N, and the application to the high voltage to the valve 12A which voltage is several times as large as the rated voltage of the electromagnetic valve 12A did provide prompt moving timing of the gas vent control valve as well as high speed moving thereof. Therefore, the gas vent control valve 9 can be closed at high speed and instantaneously upon detection of the molten metal splash by the detection member 10.

In order to further demonstrate superiority on the combination of the control circuit 11 and the improved valve driving mechanism 12 according to the present invention, the following experiments have been conducted:

(A) Firstly, experiments were conducted for measuring a period during which a gas vent passage is completely filled with molten metal. In the actual injection molding, the period for filling the gas vent passage with the molten metal is extremely important in order to avoid the overflow of the molten metal through the gas vent control valve. If the gas vent control valve is not closed within this filling period, the molten metal is leaked therethrough. Therefore, the molten metal filling period within the gas vent passage was initially investigated.

Figure 11:
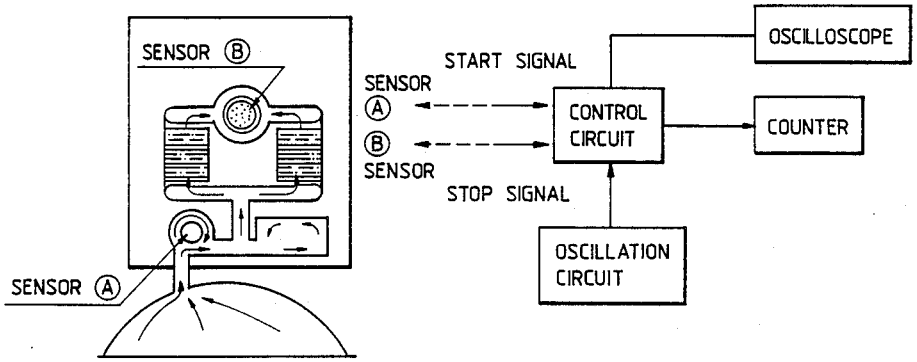
FIG. 11 is an electrical circuit diagram for measuring a period for filling a gas vent passage with a molten metal.

An illustration shown in FIG. 11 shows a circuit for measuring the filling period. A molten metal detection sensor A was disposed at immediately downstream side of the mold cavity (that is, at a position where the detection member 10 of the present invention is placed), and a second molten metal sensor B was disposed at a position corresponding to the gas vent control valve. With using this circuit, time difference was measured. That is, measured was the difference between the time at which the molten metal was detected by the second sensor B and the time at which the molten metal was detected by the molten metal sensor A.

The mold cavity was so shaped as to provide a rocker lever housing.

(a) Details of the product is as follows:

Name of product: rocker lever housing

Material: ADC 10 [defined by JIS, aluminum alloy containing Al, Si (8.5%) and Cu (3.0%)]

Shot weight: about 6.6 kgf (the weight of the metal at the gas vent passage was 500 gf)

Weight of the product; about 4.6 kg;

(b) High speed injection condition is as follows;

Molding machine; AC800A (Toshiba Machine Co.,Ltd.)

Injection speed (plunger speed); 1.9–2.0 m/sec.

Temperature of metal mold; 200° to 250° C.

Temperature of molten metal; 660° to 680° C.

Gage pressure (injection pressure); 200 kgf/cm$^2$

Molten metal pressure; 580 kgf/cm$^2$

Piston Diameter; 100 mm

Area of a gate; 453 mm$^2$

Speed of molten metal at the gate; 35 m/sec.

Vaccum was applied to the gas vent passage.

(c) Measured test results (molten metal filling period at the gas vent passage) were as follows;

Testing times; 159 times

Mean value; 19.7 msec.

Standard deviation; 3.9 msec.

Maximum value; 31.5 msec.

Minimum value; 16.0 msec.

As is apparent from the above, the gas vent passage was immediately filled with the molten metal in case of the high speed injection in accordance with the condition (b) described above. Therefore, in this injecting condition, it was understood that the gas vent control valve must be closed within 19.7 msec. after the detection member detects the molten metal, otherwise the molten metal may be leaked outside through the gas vent control valve.

Figure 10:
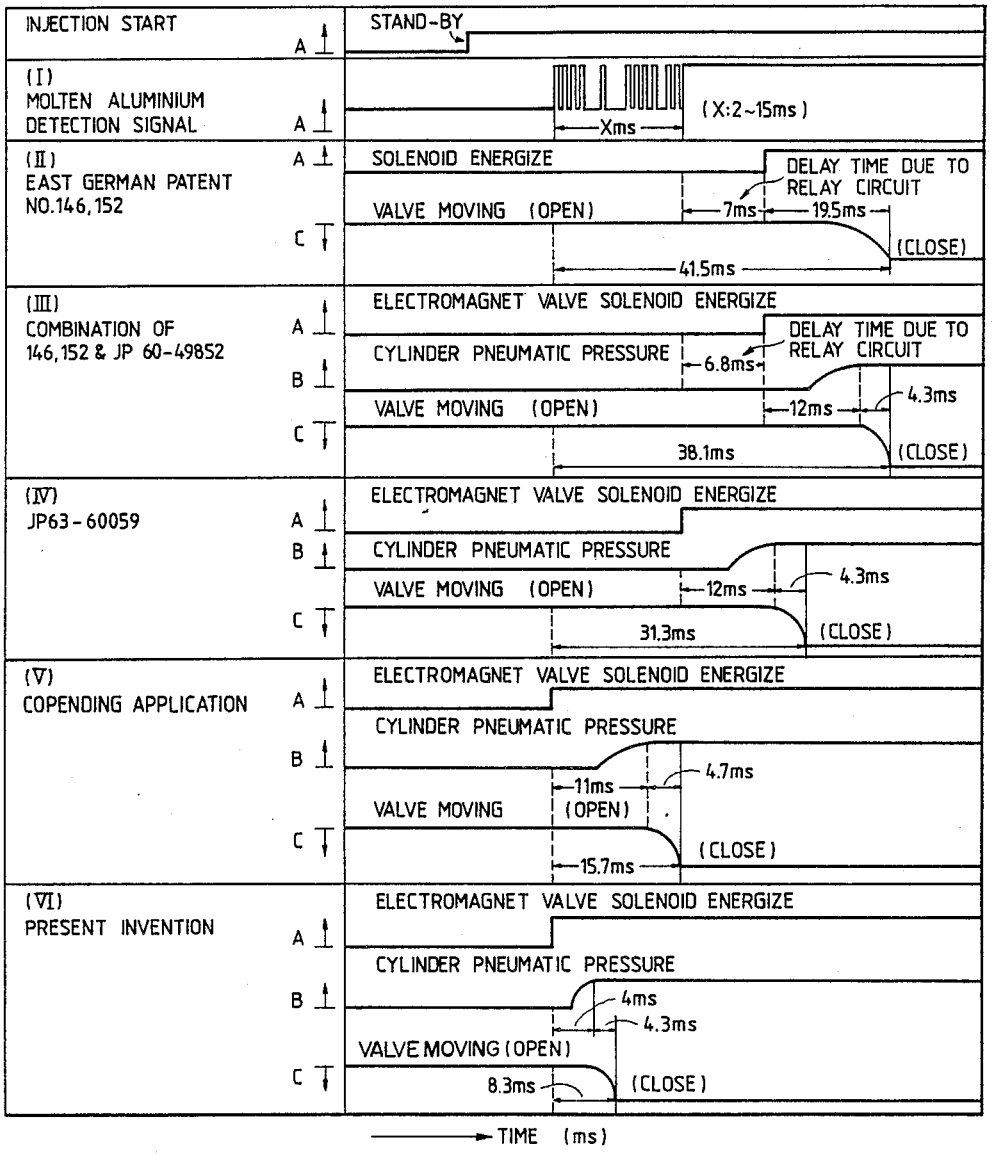
FIG. 10 is a graphical representation showing actuation timing of the gas vent control valves.

Further, in this experiments, the sensor A detected molten metals as shown in Section (I) of FIG. 10. In the Section (I), the voltage is frequently changed between high and low levels in an extremely short period. The molten metal passed through the gate portion at extremely high speed such as 35 m/sec. (see "speed of molten metal at the gate" described at item (A)-(b)). Such high speed injection would provide turbulent flow of the molten metal, and the molten metal becomes splash forms. When such molten metal splash passes through the mold cavity and contacts the detection member 10, ON state (high level state in section (I)) is provided. When a second splash reaches and contacts the detection member, the second ON state is provided. Because of the application of vacuum in the gas vent passage, the formation of splashes is accelerated, and therefore, such pulsating voltage having high frequency is provided. In other words, the detection signal from the detection member 10 will generate pulse form voltage dependent on the molten metal splashes, such pulse being indicative of scattered molten metal splashes. Since the molten metal is formed of an electrically conductive material, the detection member 10 detects the molten metal when the molten metal splashes are discontinuously contacted with the detection member 10 within an extremely short period of time. These splashes do provide such pulsating voltage line or high frequency pulse shown in Section (I) of FIG. 10 at every detections.

According to 159 times testings, the pulsating period (X) was in a range of 2 milliseconds to 15 milliseconds.

(B) Next, prepared were gas vent control systems in accordance with (a) East German Patent No. 146,152, (b) the combination of the East German Patent and the JP No. 60-49852, (c) JP No. 63-60059, (d) invention described in the copending application Ser. No. 128,185 and (e) the present invention.

(a) Gas vent control system in East German Patent

Ordinary available relay circuit and a solenoid were used. The relay circuit was NC 2D-JP-DC 5V (product of Matsushita Electric), and the solenoid was DS-15B-401 (CKD). Evaluated were operation timings with respect to the relay circuit, the solenoid, and the closure of the gas vent control valve after the detection member detects the molten metal. For these evaluations, prepared were a simulating apparatus shown in FIG. 12 and an illustration shown in FIG. 13 which was a solenoid driving circuit. An iron core of the solenoid had a moving stroke of 2.5 mm.

Figure 12:
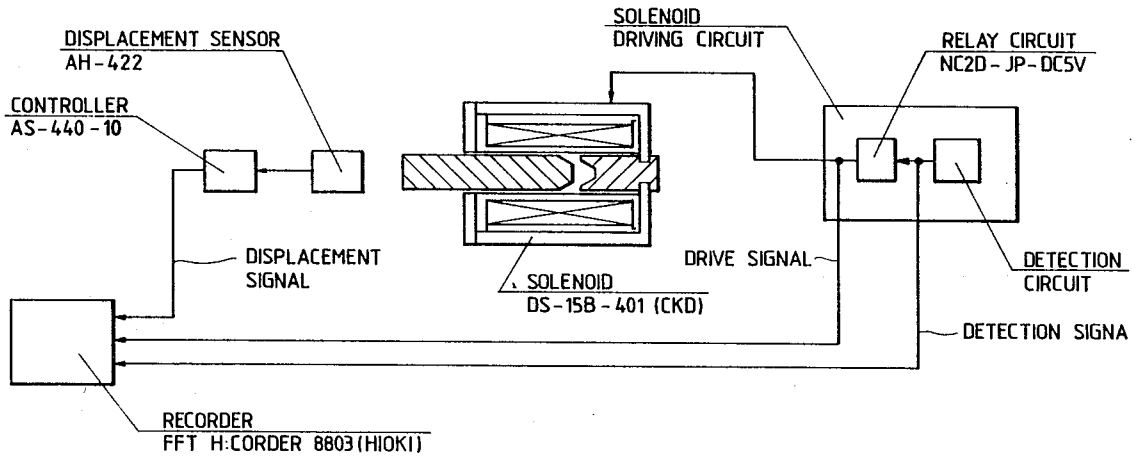
FIG. 12 is an electrical circuit diagram showing a simulating gas vent arrangement described in East German Patent No. 146,152.
Figure 13:
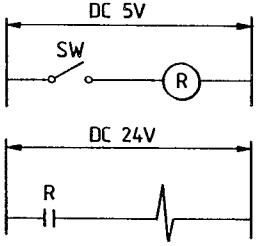
FIG. 13 shows a solenoid drive circuit used in the arrangement shown in FIG. 12.

With using the apparatus shown in FIG. 12 and the driving circuit shown in FIG. 13, ON/OFF operation of a limit switch SW was regarded as the detection and non-detection of the molten metal by a detection member. And, timings of output (drive signal) from the relay circuit and the position (displacement signal) of the core of the solenoid were measured, after the limit switch SW was turned ON (for generating detection signal). It should be noted that the displacement of the core is considered to be equivallent to the displacement of the gas vent control valve.

displacement sensor—AH-422 (Keyence Corp.)

controller—AS-440-10 (Keyence Corp.)

recorder—FFT Hi Corder 8803 (HIOKI Electric Corp.)

relay—NC2D-JP-DC5V (Matsushita Electric Industrial Co., Ltd)

solenoid—DS-15B-401 (CKD Corp.) Test results are shown in Section (II) of FIG. 10.

(b) Gas vent control system in accordance with the combination of the East German Patent and JP No. 60-49852

By this combination, prepared were the relay circuit, an electromagnetic valve and a pneumatic cylinder. Evaluated were operation timings with respect to the relay circuit, the solenoid and the compressed air supply to the pneunatic cylinder for moving a piston to close the gas vent control valve, after detection of the molten metal. For the evaluations, prepared were a simulating apparatus shown in FIG. 14 and FIG. 15 which was an electromagnetic valve driving circuit. A tubular member having inner diameter of 4 mm and a length of 50 mm was used to connect the electromagnetic valve to the pneumatic cylinder. The pneumatic cylinder had an inner bore diameter of 19.5 mm and bore stroke of 2.5 mm. By the displacement of a piston of the pneumatic cylinder by 2.5 mm, an internal volume of a chamber A was changed from 1.2 cc to 1.9 cc.

dynamic strain amplifier—DPM-311A (Kyowa Electronic Instruments Co., Ltd.)

displacement sensor—AH-422 (Keyence Corp.)

electromagnetic valve-030EIDC24V (Koganei Ltd.)

pressure sensor—PS-5KB (Kyowa Electronic Instruments Co., Ltd.)

relay circuit—NC2D-JP-DC5V (Matsushita Electric Industrial Co., Ltd.)

controller—AS-440-10 (Keyence Corp.)

recorder—FFT Hi CORDER 8803 (HIOKI Electric Corp.)

pneumatic source—5 kgf/cm$^2$

Figure 14:
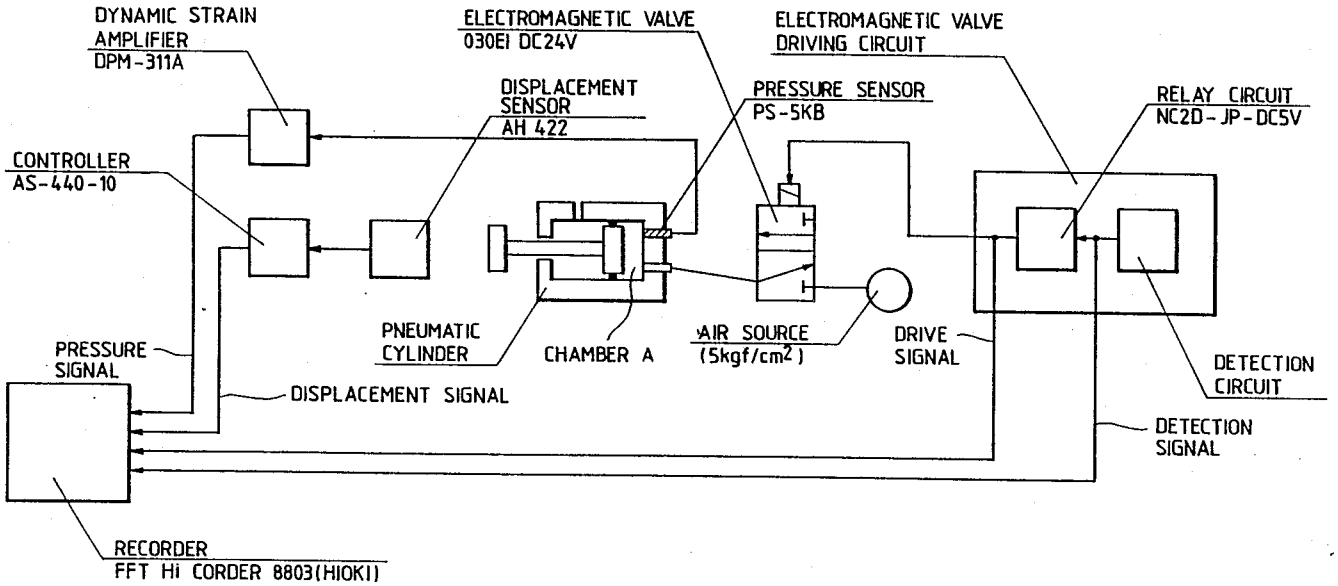
FIG. 14 is an electrical circuit diagram showing a simulating gas vent arrangement according to a combination of the East German Patent No. 146,152 and JP No. 60-49852.
Figure 15:
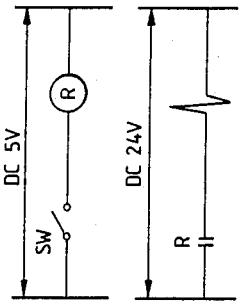
FIG. 15 shows an electromagnetic valve drive circuit used in the arrangement shown in FIG. 14.

With using the apparatus shown in FIG. 14 and the driving circuit in FIG. 15, ON/OFF operation of a limit switch SW was made. This operation can be regarded as detection and non-detection of the molten metal by a detection member. And, output signal (drive signal) from the relay circuit, pressure change (pressure signal) in the pneumatic cylinder, and displacement of the piston (displacement signal) were measured after the limit switch was turned ON (which is equivallent to the case where the detection member detects the molten metal).

Test results are shown in Section (III) of FIG. 10.

(c) Gas vent control system in JP No. 63-60059

Prepared were the switching circuit, an electromagnetic valve and a pneumatic cylinder. Evaluated were operation timings with respect to the switching circuit, the solenoid and the compressed air supply to the pneumatic cylinder for moving a piston to close the gas vent control valve, after detection of the molten metal. For the evaluations, prepared were a simulating apparatus shown in FIG. 16 and FIG. 17 which was an electromagnetic valve driving circuit. A tubular member having inner diameter of 4 mm and a length of 50 mm was used to connect the electromagnetic valve to the pneumatic cylinder. The pneumatic cylinder had an inner bore diameter of 19.5 mm and bore stroke of 2.5 mm. By the displacement of a piston of the pneumatic cylinder by 2.5 mm, an internal volume of a chamber A was changed from 1.2 cc to 1.9 cc.

dynamic strain amplifier—DPM-311A (Kyowa Electronic Instruments Co., Ltd.)

displacement sensor—AH-422 (Keyence Corp.)

electromagnetic valve-030EIDC24V (Koganei Ltd.)

pressure sensor—PS-5KB (Kyowa Electronic Instruments Co., Ltd.)

switching circuit—2SC3247 (Mitsubishi Electric Corp.)

controller—AS-440-10 (Keyence Corp.)

recorder—FFT Hi CORDER 8803 (HIOKI Electric Corp.)

pneumatic source—5 kgf/cm$^2$

Figure 16:
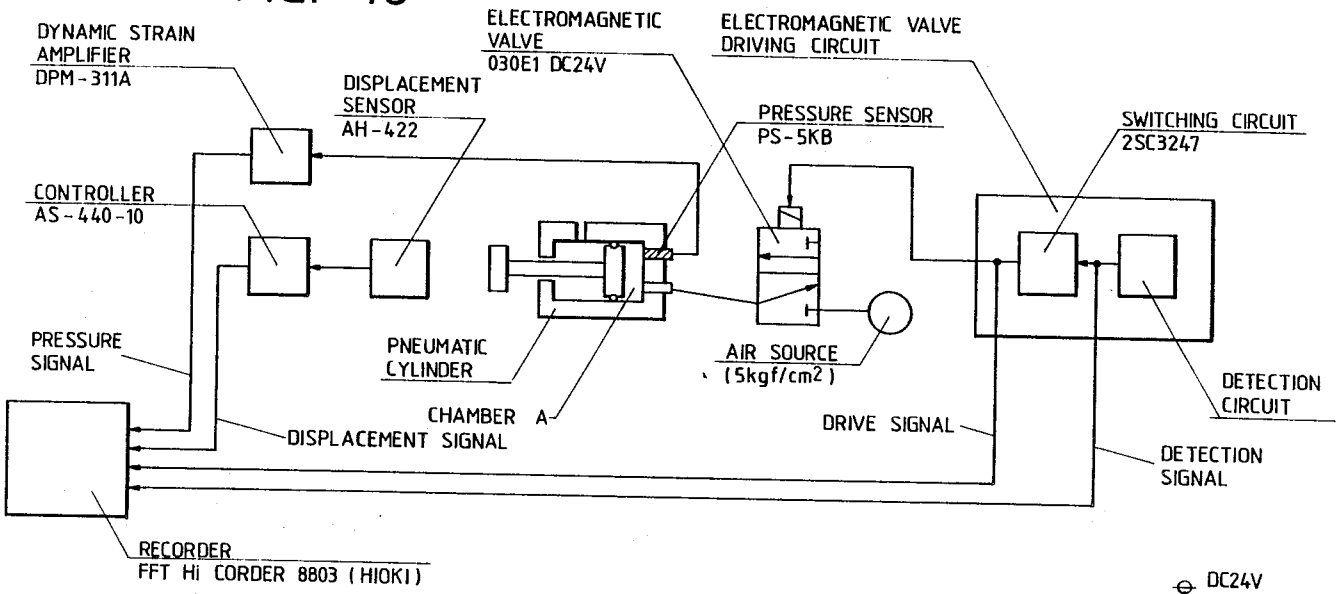
FIG. 16 is an electrical circuit diagram showing a simulating gas vent arrangement described in JP No. 63-60059.
Figure 17:
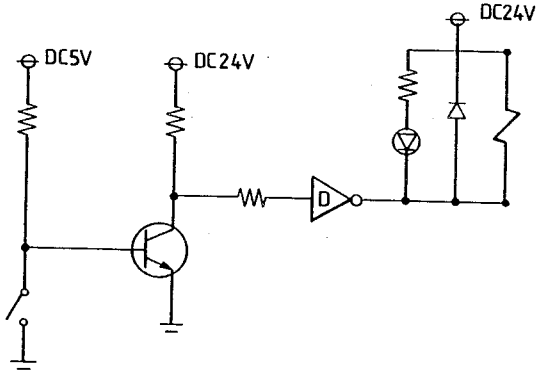
FIG. 17 shows an electromagnetic drive circuit used in the arrangement shown in FIG. 16.

With using the apparatus shown in FIG. 16 and the driving circuit in FIG. 17, ON/OFF operation of a limit switch SW was made. This operation can be regarded as detection and non-detection of the molten metal by a detection member. And, output signal (drive signal) from the switching circuit, pressure change (pressure signal) in the pneumatic cylinder, and displacement of the piston (displacement signal) were measured after the limit switch was turned ON (which is equivallent to the case where the detection member detects the molten metal). Test results are shown Section (IV) of FIG. 10.

(d) Gas vent control system in the copending application

Prepared were the flip-flop circuit, an electromagnetic valve and a pneumatic cylinder. Evaluated were operation timings with respect to the flip-flop circuit, the electromagnetic valve solenoid and the compressed air supply to the pneumatic cylinder for moving a piston to close the gas vent control valve, after detection of the molten metal. For the evaluations, prepared were a simulating apparatus shown in FIG. 18 and FIG. 19 which was an electromagnetic valve driving circuit. A tubular member having inner diameter of 4 mm and a length of 50 mm was used to connect the electromagnetic valve to the pneumatic cylinder. The pneumatic cylinder had an inner bore diameter of 19.5 mm and bore stroke of 2.5 mm. By the displacement of a piston of the pneumatic cylinder by 2.5 mm, an internal volume of a chamber A was changer from 1.2 cc to 1.9 cc.

dynamic strain amplifier—DPM-311A (Kyowa Electronic Instruments Co., Ltd.)

displacement sensor—AH-422 (Keyence Corp.)

electromagnetic valve-030EIDC24V (Koganei Ltd.)

pressure sensor—PS-5KB (Kyowa Electronic Instruments Co., Ltd.)

flip-flop circuit—M 4013 BP (Mitsubishi Electric Corp.)

controller—AS-440-10 (Keyence Corp.)

recorder—FFT Hi CORDER 8803 (HIOKI Electric Corp.)

pneumatic source—5 kgf/cm$^2$

Figure 18:
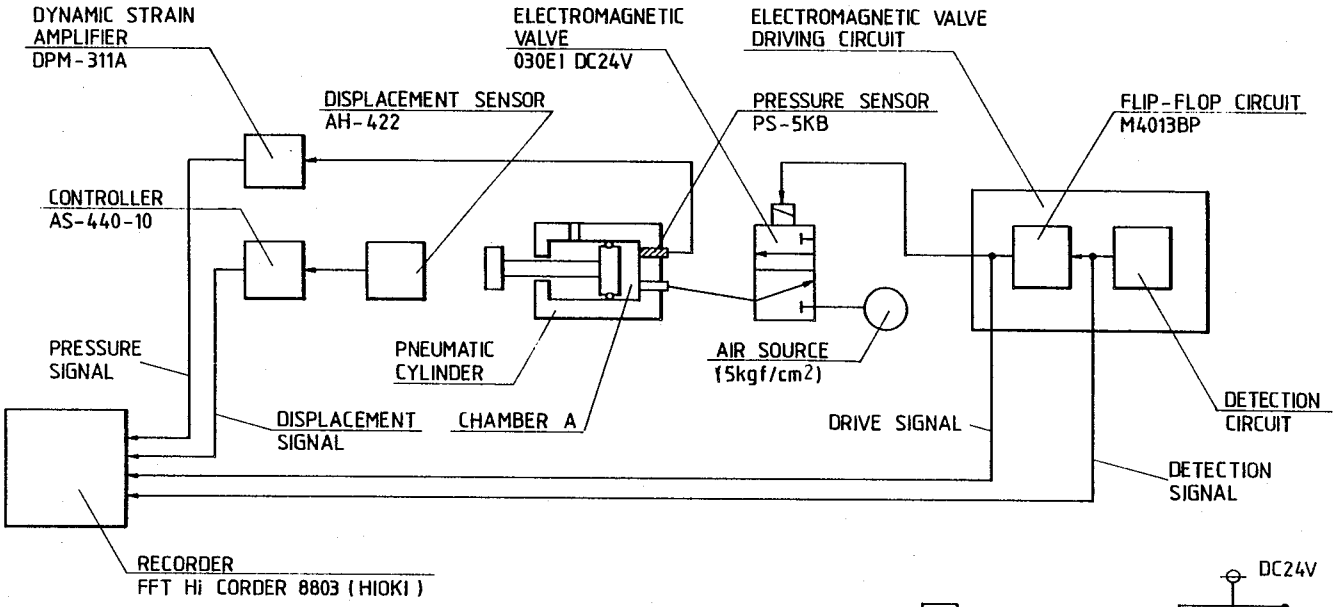
FIG. 18 is an electrical circuit diagram showing a simulating gas vent arrangement described in copending U.S. patent application Ser. No. 128,185.
Figure 19:
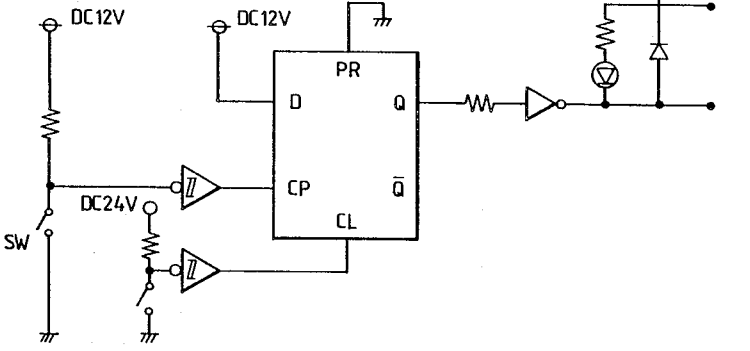
FIG. 19 shows an electromagnetic drive circuit used in the arrangement shown in FIG. 18.

With using the apparatus shown in FIG. 18 and the driving circuit in FIG. 19, ON/OFF operation of a limit switch SW was made. This operation can be regarded as detection and non-detection of the molten metal by a detection member. And, output signal (drive signal) from the flip-flop circuit, pressure change (pressure signal) in the pneumatic cylinder, and displacement of the piston were measured after the limit switch was turned ON (which is equivallent to the case where the detection member detects the molten metal).

Test results are shown in Section (V) of FIG. 10.

(e) Gas vent control system in the present invention.

Prepared were the flip-flop circuit, an electromagnetic valve, a pneumatically operated valve and a pneumatic cylinder. Evaluated were operation timings with respect to the flip-flop circuit, the electromagnetic valve solenoid and the compressed air supply to the pneumatic cylinder for moving a piston to close the gas vent control valve, after detection of the molten metal. For the evaluations, prepared were a simulating apparatus shown in FIG. 20 and FIG. 21 which was a driving circuit for driving the electromagnetic valve. A tubular member having inner diameter of 4 mm and a length of 50 mm was used to connect the pneumatically operated valve to the pneumatic cylinder. The pneumatic cylinder had an inner bore diameter of 19.5 mm and bore stroke of 2.5 mm. By the displacement of a piston of the pneumatic cylinder by 2.5 mm, an internal volume of a chamber A was changed from 1.2 cc to 1.9 cc.

dynamic strain amplifier—DPM-311A (Kyowa Electronic Instruments Co., Ltd.)

displacement sensor—AH-422 (Keyence Corp.)

electromagnetic valve—101E1 DC5V (Koganei Ltd.)

Figure 20:
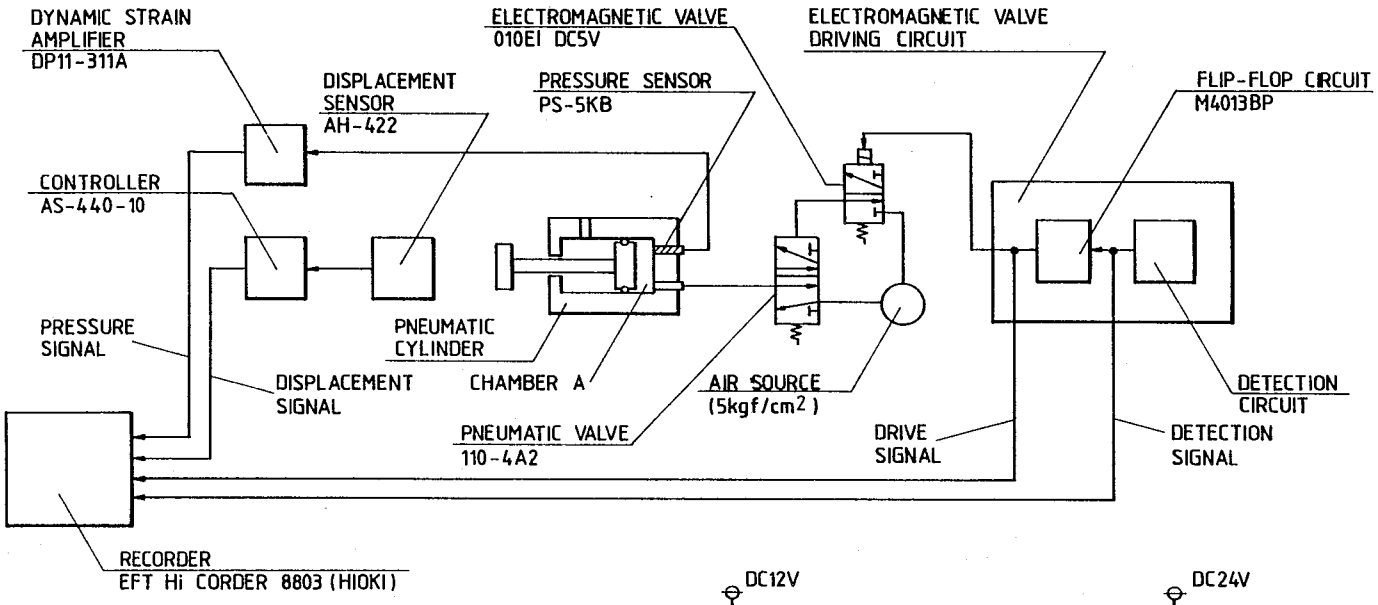
FIG. 20 is an electrical circuit diagram showing a simulating gas vent arrangement according to the present invention.
Figure 21:
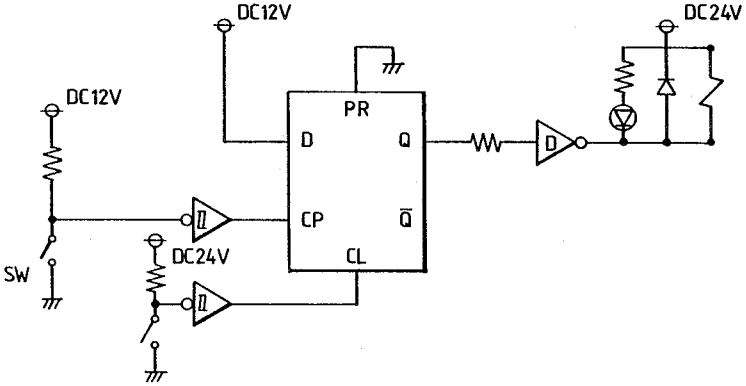
FIG. 21 shows a drive circuit for driving an electromagnetic valve used in the arrangement shown in FIG. 20.

(corresponding to the electromagnetic valve 12A in FIG. 5)

pneumatic valve—110-4A2 (Koganei Ltd.) (corresponding to the pneumatically operated valve 12N in FIG. 5)

pressure sensor—PS-5KB (Kyowa Electronic Instruments Co., Ltd.)

flip-flop circuit—M 4013 BP (Mitsubishi Electric Corp.)

controller—AS-440-10 (Keyence Corp.)

recorder—FFT Hi CORDER 8803 (HIOKI Electric Corp.) pneumatic source—5 kgf/cm$^2$ With using the apparatus shown in FIG. 20 and the driving circuit in FIG. 21, ON/OFF operation of a limit switch SW was made. This operation can be regarded as detection and non-detection of the molten metal by a detection member. And, output signal (drive signal) from the flip-flop circuit, pressure change (pressure signal) in the pneumatic cylinder, and displacement of the piston were measured after the limit switch was turned ON (which is equivallent to the case where the detection member detects the molten metal).

Test results are shown in Section (VI) of FIG. 10.

(C) Analysis (1) Section (II) of FIG. 10

Section (II) schematically shows test result of the gas vent system in East German Patent No. 146,152 where the relay circuit is provided. In case of the relay circuit, energization timing of the solenoid was so delayed by 9 milliseconds (minimum delay—2 msec plus 7 msec) or by 22 milliseconds (maximum delay—15 msec plus 7 msec.) after the first detection of the molten metal splash. This implies that the solenoid cannot be energized by frequent ON OFF pulses issued from the limit switch, i.e., by the high frequency pulsating detection signal from the detection member.

In case of the relay, the limit switch must be closed for a predetermined period of time (long term input is needed), otherwise the relay cannot perform its memory function. That is, the relay generally requires a coil to which an electrical current is applied as an input signal. The coil has an electromagnetic force so that an armature is opened or closed as an output signal from the relay. This magnetic force will attract the armature to maintain close state of the relay.

The solenoid can only be energized by continuous ON state of the limit switch. That is, a predetermined period of time (for 7 msec. detection period) is required after closing the limit switch for starting electric currect supply to a coil of the solenoid so as to obtain magnetic force in the coil and to activate the magnet in order to attract the armature. The relay is not operated only by the pulse signal which is indicative of the detection of the molten metal splashes, since electromagnetic force cannot be generated by such pulsating voltage. The relay is only operable by the stabilized input signal such as continous closure of the limit switch SW for a given period of time (7 msec), i.e., continous detection of the molten metal by the detection member.

After the solenoid is energized, the iron core of the solenoid is moved to a position which allows the gas vent control valve to be closed. This moving requires a period of 19.5 milliseconds, Accordingly, it took 28.5 milliseconds (minimum period, 9 msec plus 19.5 msec) or 41.5 milliseconds (maximum period, 22 msec. plus 19.5 msec) for completely closing the gas vent control valve after the first detection of the molten metal splash by the detection member. Here, remind back to the test result in item (A). The gas vent passage starting from the outlet portion of the mold cavity and ending at the gas vent control valve was filled with the molten metal by average period of 19.7 milliseconds, and by minimum period of 16.0 milliseconds. Therefore, if the gas vent control valve is closed by 28.5 thru 41.5 milliseconds after the first detection of the molten metal splash, the molten metal may be leaked through the gas vent control valve, since the molten metal reaches the gas vent control valve by the average period of 19. 7 milliseconds. Accordingly, the gas vent system in the East German Patent is not available for the high speed injection carried out under the condition shown in item (A)-(b), due to long delay of closure of the gas vent control valve.

(2) Section (III) of FIG. 10

Section (III) schematically shows test result of the gas vent system according to the combination of East German Patent No. 146,152 and JP No. 60-49852. As is apparent from the section (III), 8.8 milliseconds (minimum value, 2 plus 6.8 msec) to 21.8 milliseconds (maximum value, 15 plus 6.8 msec) were required for the actuation of the electromagnetic valve counting from the first pulse of the limit switch, i.e., first detection of the molten metal splash by the detection member. As described above, the relay cannot be operated by the pulsating signal whose duration was from 2 milliseconds to 15 millisecond. Further, 6.8 milliseconds were required for the actuation of the electromagnetic valve since it took this period for the memory in the relay i.e., for finally closing the armature of the relay. Furthermore, 12 milliseconds were required for producing sufficient level of pneumatic pressure within the pneumatic cylinder counting from the complete energization timing of the electromagnetic valve. And moreover, 4.3 milliseconds were required for completely closing the gas vent control valve (final moving position of the piston of the pneumatic cylinder) in response to the pneumatic pressure. Accordingly, from 25.1 to 38.1 milliseconds were required (X plus 6.8 plus 12 plus 4.3 msec) for completely closing the gas vent control valve counting from the first detection of the molten metal at the detection member. Therefore, this period exceeds the above mentioned average molten metal filling period of 19.7 milliseconds, to thereby disadvantageously cause leakage of the molten metal through the gas vent control valve.

(3) Section (IV) of FIG. 10

Section (IV) schematically shows test result of the gas venting system according to JP No. 63-60059 in which the switching circuit and the electromagnetic valve were used. Generally, the switching circuit cannot detect high frequency pulse within short period. Therefore, no output signal can be sent from the switching circuit to the electromagnetic valve for the pulsating period X (2 to 15 milliseconds) shown in column (I), but the switching circuit can first produce output signal when the molten metal detection signal is continuously sent. Accordingly, there was a first delay for the period of X. On the other hand, the switching circuit does not provide memory function, there are no time delay corresponding to the delay time of 7 milliseconds in column (II) or 6.8 milliseconds in column (III). Further, after the electromagnetic valve was energized, 12 milliseconds were required for producing sufficient level of pneumatic pressure within the pneumatic cylinder similar to column (III). And moreover, 4.3 milliseconds were required for completely closing the gas vent control valve (final moving position of the piston of the pneumatic cylinder) in response to the pneumatic pressure similar to column (III). Accordingly, from 18.3 to 31.3 milliseconds were required (X plus 12 plus 4.3) for completely closing the gas vent control valve counting from the first detection of the molten metal at the detection member.

Further, since the switching circuit does not provides the memory function (self holding function), molten metal may be leaked into the gas vent control valve in the following situations:

Firstly, during the molten metal injection, if the molten metal is intermittently or discontinuously advanced into the gas vent passage, a space is provided between the leading molten metal stream and the following molten metal stream. Therefore, if the space is comming to the position corresponding to the detection member, no detection signal is issued from the detection member. Therefore, the switching circuit does not generate the output signal to the electromagnetic valve. As a result, leading molten metal stream may be leaked through the gas vent control valve.

Secondly, if the molten metal within the gas vent control valve is partially solidified, the molten metal mass may be shrinked, so that there is a likelyhood that molten metal is separated from the detection member. In this case, the switching circuit does not provide output signal for driving the electromagnetic valve.

(4) Section (V) of FIG. 10

Section (V) schematically shows test result of the gas vent system according to the copending application, wherein the flip-flop circuit is provided. As in apparent from the section (V), the flip flop circuit can start its memory function instantaneously upon detection of the leading edge pluse, so that the drive signal from the flip flop circuit can be promptly generated concurrent with the detection of the leading edge pulse (leading edge pulse signal indicative of the detection of the first molten metal splash by the detection member 10). More specifically, in the flip flop circuit, the voltage level of the Q terminal is changed from Low level to High level in response to the leading edge detection for starting memory function. Accordingly, almost zero period is required for the completion of memory function and for energizing the electromagnetic valve. In other words, the period (X plus 7) msec in case of section II or the period (X plus 6.8) msec in case of section III were not required, which period had been required for non actuation of the relay during pulsating voltage period and delayed generation of the output signal from the relay after the stable voltage period. Then, similar to the Section (III), after the drive signal was issued, it took 11 milliseconds for generating sufficient level of pneumatic pressure in the pneumatic cylinder counting from the energization timing of the electromagnetic valve, and it took 4.7 milliseconds for moving the gas vent control valve to its close position (for moving the piston of the pneumatic cylinder to that position) counting from the timing at which sufficient pneumatic pressure was established in the cylinder. Therefore, in the copending application, only 15.7 milliseconds (11 plus 4.7 msec) was required for closing the gas vent control valve counting from the detection of the first molten metal splash by the detection member. Apparently, 15.7 milliseconds is sufficiently short enough for avoiding molten metal leakage through the gas vent control valve, taking the average filling period of 19.7 milliseconds into consideration.

(5) Section (VI) of FIG. 10.

Section (VI) schematically shows test results of the gas venting arrangement according to this invention. Similar to the Section (V), since the flip-flop circuit was used, it can start its memory function instantaneously upon detection of the leading edge pulse, so that the drive signal from the flip flop circuit can be promptly generated concurrent with the detection of the leading edge pulse. Therefore, almost zero period was required for the completion of memory function and for sending output singal to the first electromagnetic valve. That is, when the CP terminal of the flip flop circuit is changed from low to high, memory function can be promptly achieved. In other words, similar to Section (V), the period (X plus 7) msec. in case of Section II or the period (X plus 6.8) msec. in case of Section III were not required in the present invention.

Further, in the present invention, since the control circuit can send high voltage level signal to the electromagnetic valve whose voltage was several times as large as the rated voltage of the electromagnetic valve, and since the electromagnetic valve had a relatively small capacity, the electromagnetic valve can be operated at high speed. Furthermore, by the fluid connection between the electromagnetic valve and the pneumatically operated valve, the compressed air is promptly supplied from the electromagnetic valve to the pneumatically operated valve for change-over operation of the pneumatically operated valve. Therefore, upon completion of the change-over operation, large volume of compressed air is applied to the valve driving cylinder through the pneumatically operated valve. That is, the electromagnetic valve functions as a trigger or starter for the pneumatically operated valve. Upon high speed operation of the electromagnetic valve, the pneumatically operated valve is also operated or changed over at high speed. As a result, large volume of compressed air is promptly applicable to the valve driving cylinder. Accordingly, only 4 milliseconds was required for producing sufficient level of pneumatic pressure within the pneumatic cylinder. This is in high contrast to the Sections III, IV and V where 11 to 12 milli-seconds were required for producing the sufficient pneumatic pressure within the pneumatic cylinder for moving its piston. After reaching the sufficient pressure within the pnuematic cylinder, it tooks 4.3 milliseconds for moving the gas vent control valve to its close position (for moving the piston of the pneumatic cylinder to that position) similar to Sections III and IV. Accordingly, in the present invention, only 8.3 milliseconds (4 plus 4.3) were required for closing the gas vent control valve counting from the detection of the first molten metal splash by the detection member. Therefore, the gas vent arrangement according to the present invention can provide extremely high speed closure of the gas vent control valve after detection of the first molten metal splash by the detection member. This speed was extremely higher than the conventional arrangements shown in Sections II through IV and than the arrangement described in the copending U.S. Patent Application shown in Section V.

(6) Conclusion

In case of the high speed injection carried out in accordance with the condition described at item (A)–(b), with applying vacuum in the gas vent passage, the molten metal was promptly filled in the gas vent passage within extremely short period of about 19.7 milliseconds (minimumly 16.0 msec. and maximumly 31.5 msec.). Therefore, the gas vent control valve must be closed within this period. Therefore, if the injection molding is achieved under the condition described at item (A)–(b), the molten metal may be leaked through the gas vent control valve in the conventional gas venting arrangements described at item (B)-(a), (b) and (c) as above.

More specifically, in case of the gas vent system in East German Patent or in accordance with the combination of the East German patent and the JP reference, from 28.5 to 41.5 milliseconds(East German Patent) or from 25.1 to 38.1 miliseconds (combination of the East German and JP reference) were required for closing the gas vent control valve counting from the detection of the first molten metal splash by the detection member, those periods being longer than the average molten metal filling period (19.7 milliseconds) within the gas vent passage or the maximum filling period of 31.5 milliseconds (see item (A)–(c)). Accordingly, if the high speed molten metal injection is carried out in accordance with the condition of item (A)–(b), the molten metal will be leaked through the gas vent control valve. Further, in case of the gas venting arrangement described in JP No. 63-60059, from 18.3 to 31.3 miliseconds were required for closing the gas vent control valve counting from the detection of the first molten metal splash by the detection member. The period of 18.3 milliseconds is longer than the minimum molten metal filling period of 16.0 milliseconds, and the period of 31.3 milliseconds is also longer than the average molten metal filling period (19.7 milliseconds) within the gas vent passage. Accordingly, if the high speed molten metal injection is carried out in accordance with the condition of item (A)–(b), the molten metal will be leaked through the gas vent control valve in case of the JP No. 63-60059.

In case of the gas venting arrangement described in the copending application, probability of the molten metal leakage through the gas vent control valve can be greatly reduced, since the gas vent control valve can be closed within 15.7 milliseconds, which is faster than the minimum period of 16.0 msec. Still however, if much higher injection speed is contemplated, another care have to be imparted on the gas venting arrangement in the copending application, for example, internal shape of the gas vent passage must be modified. Alternatively, the maximum injection speed must be within the condition described at item (A)–(b).

On the other hand, the gas venting arrangement in accordance with the present invention can provide extremely high valve closing speed such as 8.3 milliseconds counting from the first molten metal detection. Therefore, in the present invention, it is almost unnecessary to deeply consider the shape and length of the gas vent passage (overflow passage), and it is also unnecessary to draw much attention to the injecting condition. In other word, the present invention is available for extremely high speed injection molding.

Next, structure of the molten metal detection member or sensor 10 will be described in detail with reference to FIGS. 22 and 23. The molten metal sensor 10 or 10A includes a metallic holder 103, a sleeve-like insulation member 102 and an electrically conductive pin 101. The holder 103 is formed with a central bore **103*a* extending in axial direction thereof, and a stepped bore 103*b* having a diameter larger than that of the stepped bore 103*a*. The stepped bore 103*b* is positioned at one end portion of the holder 103 at a position close to the molten metal passage, and the insulating sleeve 102 is tightly fitted with the stepped bore 103*b*. An inner bore 102*a* of the insulating sleeve 102 has an inner diameter D as shown. Further, the electrically conductive pin 101 extends through the inner bore 102*a* of the insulating sleeve 102 and the central bore 103*a* of the holder 103. Therefore, the pin 101 is electrically insulated from the holder 103 by the insulating sleeve 102. The pin 101 has a head portion 101*a* and a stem portion 101*b*, and a planar end of the head 101*a* is positioned outside the insulating sleeve 102**, so that the molten metal can be contacted with the planar end.

The stem portion **101*b* of the pin 101 has an outer diameter d smaller than the inner diameter D of the insulating sleeve 102. Therefore, a hollow space 104 extending in axial direction of the pin 101 is defined between the stem portion and the insulating sleeve. When the pin 101 contacts the molten metal having high temperature, the pin 101 is thermally expanded. However, this thermal expansion does not affect the insulation sleeve 102 because of the formation of the hollow space 104. In other words, the hollow space 104 has a sufficient radial distance such that the outer peripheral surface of the pin 101 is not comming into contact with the inner peripheral surface 102*a* of the insulating sleeve 102**.

However, the formation of the hollow space 104 may allow the molten metal to enter into the interior of the holder 103 through the space 104. In this case, the pin 101 is electrically connected to the holder, so that resultant sensor 10 does not perform its molten metal detecting function. In order to avoid this, the head portion **101*a* is provided which has an enlarged diameter than the stem portion 101*b*. With the structure, the head portion 101*a* is in intimate contact with an axially end face of the insulation sleeve 102, so that the head portion 101*a* closes one open end of the hollow space 104. As a result, molten metal cannot be entered into the hollow space 104**.

The detection member according to this invention further includes means for maintaining close contact between the head portion **101*a* and the end face of the insulating sleeve 102. This maintaining means includes a thread portion 101*e* formed at the stem portion 101*b* at a position opposite the head portion 101*a*, and a nut 107 threadingly engaged with the thread portion 101*e*. More specifically, the holder 103 has another end portion formed with a bore 103*c* which has an enlarged inner diameter, and a bottom end 103*d* of the bore 103*c* functions as a stop portion. Between the bottom end 103*d* and the nut 107, an insulating washer 105 and a spring washer 106 are interposed. Therefore, the pin 101 is electrically insulated from the holder 103 by the insulating washer 105, and further, the spring washer 106 prevents the pin 101 from loose engagement with the nut 107**, and absorbs thermal expansion of the pin 101 in axial direction thereof. In order to further avoid loose enagemenet between the pin and the nut 107 due to thermal expansion of the pin in its axial direction, the temperature of the pin 101 is provisionally elevated to the temperature of molding work, and then, the pin is fastened with the nut 107. By this provisional treatment, loose engagement of the pin is further avoidable.

Figure 22:
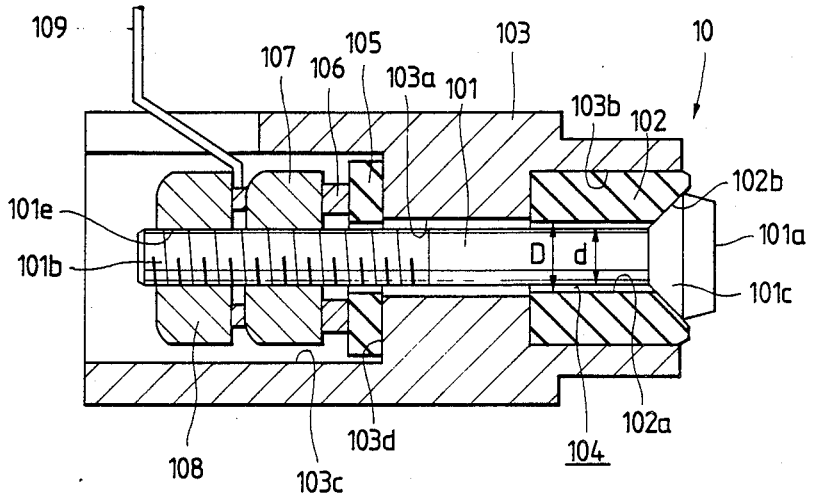
FIG. 22 is a cross-sectional view showing a detection member or a molten metal sensor used in the present invention.
Figure 23:
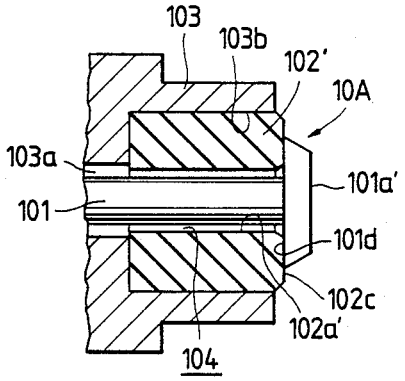
FIG. 23 is a cross-sectional view showing a detection member or a molten metal sensor according to a modified embodiment of this invention; and, FIG. 24 is a schematic illustration showing example of positions of the molten metal sensor relative to an injection molding apparatus.

In the embodiment show in FIG. 22, the head 101*a* of the pin 101 has a tapered shape 101*c* in which the outer diameter is gradually increased toward the axial end. Further, axially end portion of the insulation sleeve 101 is formed with a corresponding frusto-conical bore 102*b*. With this structure, the head 101*a* can be tightly contacted with the end face of the insulation sleeve 102. Alternatively, in the embodiment shown in FIG. 23, inner end face 101*d* of the head portion 101*a*' is formed in a flat surface, and a planar end face 102*c* of the insulation sleeve 102' is also formed in a flat surface.

As shown in FIG. 22, the thread portion 101*e* is also threaded with a second nut 108, and a line 109 is fixedly held between the nuts 107 and 108 so as to transmit electrical current to the control circuit 11.

The material of the pin 101 must be electrically conductive and must have sufficient corrosion resistance against the molten metal. Further, the material must be hardly oxidizable. For example, available are stainless steel, STELLITE (a hard, wear- and corrosion resistant family of non-ferrous alloys of cobalt(20–65%), chromium(11–32%), and tungsten(2–5%), resistance to softening is exceptionally high at high temperature), SIALON (sintered silicon nitride, containing not less than 70 wt % of $Si_3N_4$), titanium nitride, and titanium carbide, or these material subjected to surface treatment with one of TiN, TiC and TiCN.

With respect to the insulating sleeve 102 102' and the insulating washer 105, the material must be electrically insulative, and must have high corrosion resistance against the molten metal and high thermal resistivity. For example, a ceramic material such as alumina, silicon nitride, SIALON, and silica is available.

In the foregoing embodiments, the molten metal detection member or sensor 10 10A is used to detect the molten metal at the gas vent passage 6. However, the sensor 10 or 10A can be disposed at various portions of the injection molding apparatus for the different purpose.

Figure 24:
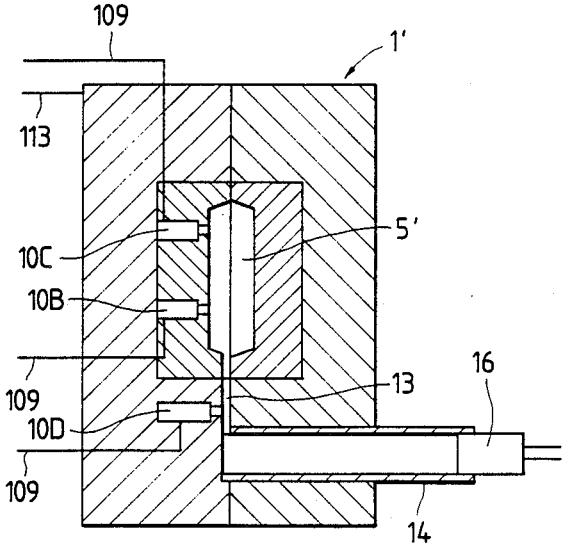

FIG. 24 shows various examples showing the positions of the sensors 10.

EXAMPLE 1

Two sensors 10B and 10C are provided at positions different in vertical direction of a mold cavity 5' formed in a metal mold 1' so as to detect the molten metal injected into the cavity. These sensors are opened to the interior space of the mold cavity 5'. Before the molten metal reaches the sensor 10B, the line 109 is insulated from a line 113 connected to the metal mold 1. However, when the molten metal reaches the sensor 10B and the molten metal contacts the pin 101 as well as the inner surface of the mold cavity 5', the lines 109 and 113 are electrically connected together, to thus generate detection signal. The same is true with respect to the upper sensor 10C. By measuring the two detection signals sent from the sensor 10B and the sensor 10C, molten meal flowing mode or flowing velocity within the metal mold can be calculated.

EXAMPLE 2

A single sensor 10D is provided at a runner 13 as shown or is provided at the cavity 5'. When the sensor 10D detects the molten metal, the plunger shot speed can be changed from low speed to high speed. In other words, the sensor 10D functions as the limit switch 19 in the embodiment shown in FIG. 6.

As described above, according to the invention, since the gas vent control valve can be promptly closed at high speed and at desirable timing, molten metal leakage through the gas vent control valve can be avoided even at the high speed injection molding operation. Such desirable timing is provided by instanteneous generation of the output signal b from the control circuit for driving the valve driving mechanism in response to the first detection of the first molten metal detection by the detection member or sensor 10, and such high speed valve closure is achieved by prompt supply of the large amount of compressed air into the valve driving cylinder because of the employment of the electromagentic valve 12A and the pneumatically operated valve 12N. The control circuit generates high voltage output signal b', which is several times as large as the rated voltage of the electromagnetic valve, in response to the output signal b, so that the electromagnetic valve 12A can perform prompt change over operation, to thereby perform prompt change over operation of the pneumatically operated valve connected to the pnuematic source. Therefore, even at the high speed casting, no molten metal leakage occurs because of the prompt closure of the gas vent control valve counting from the first detection of the molten metal.

Further, in the present invention, such improved result is attainable by using known electromagnetic valve and known pneumatically operated valve. Therefore, resultant valve driving mechanism can be provided at low cost.

Furthermore, in the present invention, the improved detection member is used, the insulating member is not damaged due to the difference in thermal expansion coefficients between the electrically conductive pin and the insulation member. Therefore, the detection member can exhibit long term service life, and therefore, it is unnecessary to replace the detection member by a new detecter. Further, no electrical insulation break down occurs, to thereby enhance reliability of the resultant gas venting arrangement, and erroneous operation is avoidable.

While the invention has been described in detail and with reference to specific embodiments thereof, it would be apparent for those skilled in the art that various changes and modifications can be made therein without departing from the spirit and scope of the invention.

What is claimed is:

1. A gas venting arrangement in an injection molding apparatus which includes a casting sleeve, mold halves defining a mold cavity therebetween, an injected molten metal being fed through the casting sleeve and molded within the mold cavity, the mold halves being formed with a gas vent passage in fluid communication with the mold cavity and positioned downstream with respect thereto, and a gas vent control valve disposed at a downstream end portion of the gas vent passage, the gas venting arrangement comprising:

a detection member for detecting molten metal and generating a detection signal;

a control circuit connected to the detection member, the control circuit generating a high voltage drive signal in response to the detection signal;

a valve driving mechanism having one end connected to the control circuit and another end connected to the gas vent control valve, the valve driving mechanism comprising:

a pneumatic source;

an electromagnetic valve connected to the pneumatic source and performing change-over operation in response to the high voltage drive signal;

a pneumatically operated valve connected to the pneumatic source and having one end connected to the electromagnetic valve and having another end; and a valve driving cylinder having one end connected to said other end of the pneumatically operated valve and having another end connected to the gas vent control valve, the pneumatically operated valve performing change-over operation in response to the change-over operation of the electromagnetic valve for applying a pneumatic pressure in the pneumatic source to the valve driving cylinder to move the gas vent control valve to its closed position.

2. The gas venting arrangement as claimed in claim 1, wherein the electromagnetic valve has a rated voltage, and wherein said high voltage signal is several times as large as the rated voltage.

3. The gas venting arrangement as claimed in claim 2, wherein said control circuit comprises a filter, an electronic circuit, and a drive circuit connected to the electronic circuit, the electronic circuit providing an output signal instantaneously upon detection of injected molten metal by the detection member, which provides instantaneous operation of the electromagnetic valve upon detection of a leading edge of a detection signal instantaneously generated by the detection of the molten metal by the detection member, said high voltage drive signal being generated in response to the output signal from the electronic circuit.

4. The gas venting arrangement as claimed in claim 3, further comprising a vacuum sucking device connected to the gas vent passage and positioned downstream of the gas vent control valve for positively discharging gas from the mold cavity during injection of the molten metal thereinto.

5. The gas venting arrangement as claimed in claim 3, wherein said electronic circuit comprises a flip-flop circuit.

6. The gas venting arrangement as claimed in claim 3, wherein said electronic circuit comprises a monostable multivibrator.

7. The gas venting arrangement as claimed in claim 3, wherein said electronic circuit comprises Eccles-Jordan circuit.

8. The gas venting arrangement as claimed in claim 3, wherein said electronic circuit comprises a trigger circuit.

9. The gas venting arrangement as claimed in claim 3, wherein said electronic circuit comprises an IC timer.

10. The gas venting arrangement as claimed in claim 3, wherein the valve driving cylinder defines first and second chambers, pneumatic pressure from the pneumatically operated valve being applied to one of the first and second chambers for moving the gas vent control valve.

11. The gas venting arrangement as claimed in claim 10, wherein said gas vent control valve is closed when the pnuematic pressure is applied to the first chamber, and wherein said electromagnetic valve has first and second positions, and said pneumatically operated valve has first and second positions; the electromagnetic valve being moved to the first position upon application of high voltage drive signal thereto so as to supply pneumatic pressure to the pneumatically operated valve, the pneumatically operated valve being moved to its first position upon application of the pneumatic pressure from the electromagnetic valve, so that pneumatic pressure from said pneumatic source is supplied to the first chamber through the pneumatically operated valve.

12. The gas venting arrangement as claimed in claim 10, further comprising a second electromagnetic valve connected to the pneumatically operated valve, said second electromagnetic valve providing change-over operation for moving said pneumatically operated valve to the second position.

13. The gas venting arrangement as claimed in claim 1, wherein said detection member is disposed at the gas vent passage, and comprises:

an electrically conductive pin having one end contactable with the molten metal;

a holder disposed in one of the mold halves for supporting therein the electrically conductive pin;

an insulating member disposed between the holder and the pin for insulating the electrically conductive pin from the holder, a space being defined between the electrically conductive pin and the insulating member, and the one end of the electrically conductive pin being enlarged for closing an open end of the space.

14. A gas venting arrangement as claimed in claim 1, wherein said electromagnetic valve has a small mass.

15. A method for venting gas in a high speed injection molding apparatus which includes a casting sleeve, mold halves defining a mold cavity therebetween, an injected molten metal being fed through the casting sleeve and molded within the mold cavity, the mold halves being formed with a gas vent passage in fluid communication with the mold cavity and positioned downstream with respect thereto, and a gas vent control valve disposed at a downstream end portion of the gas vent passage; the method comprising the steps of:

detecting molten metal by a detection member provided in the gas vent passage;

sending to a control circuit a first detection signal indicative of first detection of the first molten metal detected by the detection member;

generating a high voltage drive signal at the control circuit;

outputting the high voltage drive signal to an electromagnetic valve for its prompt change-over operation;

performing change-over operation of a pneumatically operated valve in response to the change-over operation of the electromagnetic valve;

supplying, through the pneumatically operated valve, a large volume of pneumatic pressure of a pneumatic source in response to the change-over operation of the pneumatically operated valve, to a valve driving cylinder connected to the gas vent control valve for closing the same.

16. A method as in claim 14, wherein said electromagnetic valve has a small mass.

* * * * *